US011505935B2

(12) United States Patent
Crevier

(10) Patent No.: US 11,505,935 B2
(45) **Date of Patent: *Nov. 22, 2022**

(54) URINAL SCREEN HAVING FOLDABLE PORTIONS

(71) Applicant: Jeffrey Scott Crevier, Fort Lauderdale, FL (US)

(72) Inventor: Jeffrey Scott Crevier, Fort Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/240,612

(22) Filed: Apr. 26, 2021

(65) Prior Publication Data

US 2021/0238838 A1 Aug. 5, 2021

Related U.S. Application Data

(63) Continuation-in-part of application No. 16/418,373, filed on May 21, 2019, now Pat. No. 10,988,918, which is a continuation-in-part of application No. 16/023,862, filed on Jun. 29, 2018, now Pat. No. 10,294,649, which is a continuation of application No. 15/342,543, filed on Nov. 3, 2016, now Pat. No. 10,036,154.

(51) Int. Cl.
*E03D 13/00* (2006.01)

(52) U.S. Cl.
CPC ..... *E03D 13/005* (2013.01)

(58) Field of Classification Search
CPC ..... E03D 9/00
USPC ..... 4/300.3, 300, 301, 415
See application file for complete search history.

(56) References Cited

U.S. PATENT DOCUMENTS 4,671,976 A * 6/1987 Vidal ..... E03C 1/264 4/293
4,866,793 A * 9/1989 Luedtke ..... E03D 9/00 4/300.3
5,313,672 A * 5/1994 Luedtke ..... E03D 9/00 4/144.1
5,398,347 A * 3/1995 Luedtke ..... E03D 9/00 4/300.3
5,774,905 A * 7/1998 Wager ..... E03D 13/00 4/309
5,809,590 A * 9/1998 Williams ..... A47K 11/12 4/300.3
6,550,075 B1 * 4/2003 Brannon, III ..... A47K 13/24 4/300.3
D639,410 S * 6/2011 Ramirez ..... E03F 5/0404 D23/310
8,043,498 B2 * 10/2011 Rueda ..... E03F 5/0404 210/348

(Continued)

*Primary Examiner* — Lori L Baker
(74) *Attorney, Agent, or Firm* — The Concept Law Group, PA; Scott D. Smiley; Scott M. Garrett

(57) ABSTRACT

A urinal screen device includes a body portion having one or more fold lines to allow the urinal screen, or a base portion of the urinal screen that sits in the urinal basin, to bend so as allow maximal coverage of the basin without compromising functionality. The fold lines are created by regions that lack the protrusions formed on body of the urinal screen to break up fluid streams and prevent back splash. The regions lacking protrusion allow the body to bend easier because there are no protrusions being forced against each other along the fold line.

16 Claims, 27 Drawing Sheets

(56) References Cited

U.S. PATENT DOCUMENTS

| | | | | |
|---|---|---|---|---|
| 8,056,153 | B2 * | 11/2011 | Ruedas | E03D 13/00 4/310 |
| 8,856,976 | B1 * | 10/2014 | Niedzielski, III | E03D 9/00 4/300.3 |
| 8,856,977 | B2 * | 10/2014 | Ramirez | E03D 13/00 4/309 |
| 2004/0093662 | A1 * | 5/2004 | Zhu | A47K 17/00 4/300.3 |
| 2015/0047114 | A1 * | 2/2015 | Ramirez | E03D 9/00 4/300.3 |
| 2015/0143624 | A1 * | 5/2015 | Irving | E03D 9/00 4/300.3 |

* cited by examiner

Prior Art

URINAL SCREEN HAVING FOLDABLE PORTIONS

CROSS REFERENCE

This application is a continuation in part of U.S. application Ser. No. 16/418,373, titled "Urinal Screen Having Folding Portions," filed May 21, 2019, which was a continuation in part of U.S. application Ser. No. 16/023,862, titled "Urinal Anti-Splash Device," filed Jun. 29, 2018, to be U.S. Pat. No. 10,988,918, which was a continuation of U.S. Appl. No. 15/342,543, titled "Urinal Anti-Splash Device," filed Nov. 3, 2016, the entireties of each of which are hereby incorporated by reference.

FIELD OF THE INVENTION

The present invention relates generally to urinal accessories, and, more particularly, relates to a urinal anti-splash device for placement within a urinal.

BACKGROUND OF THE INVENTION

A urinal, often installed for efficiency when compared to a general purpose toilet, is a sanitary plumbing fixture commonly located in male restrooms. The use of a urinal, in comparison to a general purpose toilet, is often more convenient for a user due to the absence of additional doors and locks. As an added convenience, urinals do not require a user to turn up a seat prior to use, which is both convenient and generally more sanitary than the toilet. Moreover, urinals occupy less space and consume less water per flush, or possibly no water at all, than a toilet which requires flushing.

Devices designed to be placed within urinals are well-known. For example, urinals found in public restrooms often have a plastic mesh guard to prevent large debris from entering the drain. Unfortunately, such plastic mesh guards fail to reduce or prevent the splashing of urine onto the user. In fact, such plastic mesh guards may actually increase the risk of the user being splashed by the urine as the urine ricochets from the plastic mesh guard. Moreover, these plastic mesh guards do not prevent the splashing of urine that is directed towards the back wall of the urinal.

Other known devices designed to be placed within urinals, often referred to as urinal screens or occasionally as urinal screens, are sized and shaped to cover either the urinal's back wall or the drain. Such urinal screens do not allow the user the option of covering both the back wall and the drain to prevent the urine from splashing onto the user from a maximum surface area of the urinal. Moreover, some urinal screens are made of a rigid material that may fail to conform to the various sizes and shapes of urinals.

Additional known devices designed for placement within a urinal often include protrusions that are densely compacted together, preventing a urine stream from flowing in a vertical direction toward the urinal screen. In this vein, such devices rely on the protrusions to break up the urine stream, leaving urine deposited on the protrusions, resulting in an unpleasant odor and the need for increased cleaning frequency of the device. Moreover, many urinal screens include urinal cakes or deodorizers which require costly and frequent replacement.

A particular problem with urinal design with respect to the design of mats or screens to prevent splashing in urinals is the variety of shapes in which urinals configured. For example, some urinals have rounded basins, while others have a narrower, more pointed basin. Accordingly, to optimize the anti-splash aspect of a urinal screen, it must fit properly in the basin. As a result, there are a similar variety of urinal screens provided for variously shaped urinal basins. However, this necessitates different molding tools to manufacture the different urinal screen shapes, it requires stocking the different urinal screen devices, and so on.

Therefore, a need exists to overcome the problems with the prior art as discussed above.

SUMMARY OF THE INVENTION

In accordance with some embodiments of the inventive disclosure, there is provided a urinal screen adaptable to a plurality of urinal configurations, that includes a main body having a plurality of protrusions extending away from the main body on a top side of the urinal screens, and at least one fold line across the top of the main body.

In accordance with another feature, the at least one fold line comprises a plurality of perforations through the urinal screen.

In accordance with another feature, the at least one fold line comprises a fold line from a front of the main body to a back of the main body.

In accordance with another feature, the main body is comprised of a honeycomb webbing defining hexagonal openings and intersecting portions of the webbing, wherein each one of the plurality of protrusions extends from a respective one of the intersecting portions and wherein the fold line is created by a reduced structure of the main body along the fold line.

In accordance with another feature, the urinal screen is joined to an anti-splash body opposite a front of the urinal screen, at a coupling region.

In accordance with another feature, the coupling region comprises a plurality of perforations along the coupling region.

In accordance with another feature, the at least one fold line comprises first, second, and third fold lines that all converge at a front of the main body.

In accordance with some embodiments of the inventive disclosure, there is provided a urinal screen that includes an anti-splash body, a base portion joined to the anti-splash body at a coupling region, the anti-splash body and base portion each comprising a plurality of protrusions extending outwardly. The base portion having at least one fold line across a top of the base portion, wherein the at least one fold line is a region along the base portion in either there is a lack of protrusions or a structure of the base portion is reduced.

In accordance with another feature, the anti-splash body and base portion each comprise a webbing comprised of connector links that are arranged to form openings through the anti-splash body and the base portion, and wherein protrusions of the plurality of protrusions extend from intersections of the connector links.

In accordance with another feature, the openings are hexagonal openings.

In accordance with another feature, at least some connector links are omitted along the at least one fold line.

In accordance with another feature, at least some connector links have a reduced thickness along the at least one fold line relative to connector links not along the at least one fold line.

In accordance with another feature, the coupling region comprises perforations.

In accordance with another feature, the plurality of protrusions extend outwardly and perpendicularly to a plane of the anti-splash body and base portion.

In accordance with another feature, there is further included a plurality of breaks at an edge of the anti-splash body and base portion.

In accordance with another feature, a material of the anti-splash body and base portion includes a fragrance oil.

Although the invention is illustrated and described herein as embodied in a urinal anti-splash device, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the body of the urinal anti-splash device in a direction from a ground surface toward a ceiling.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
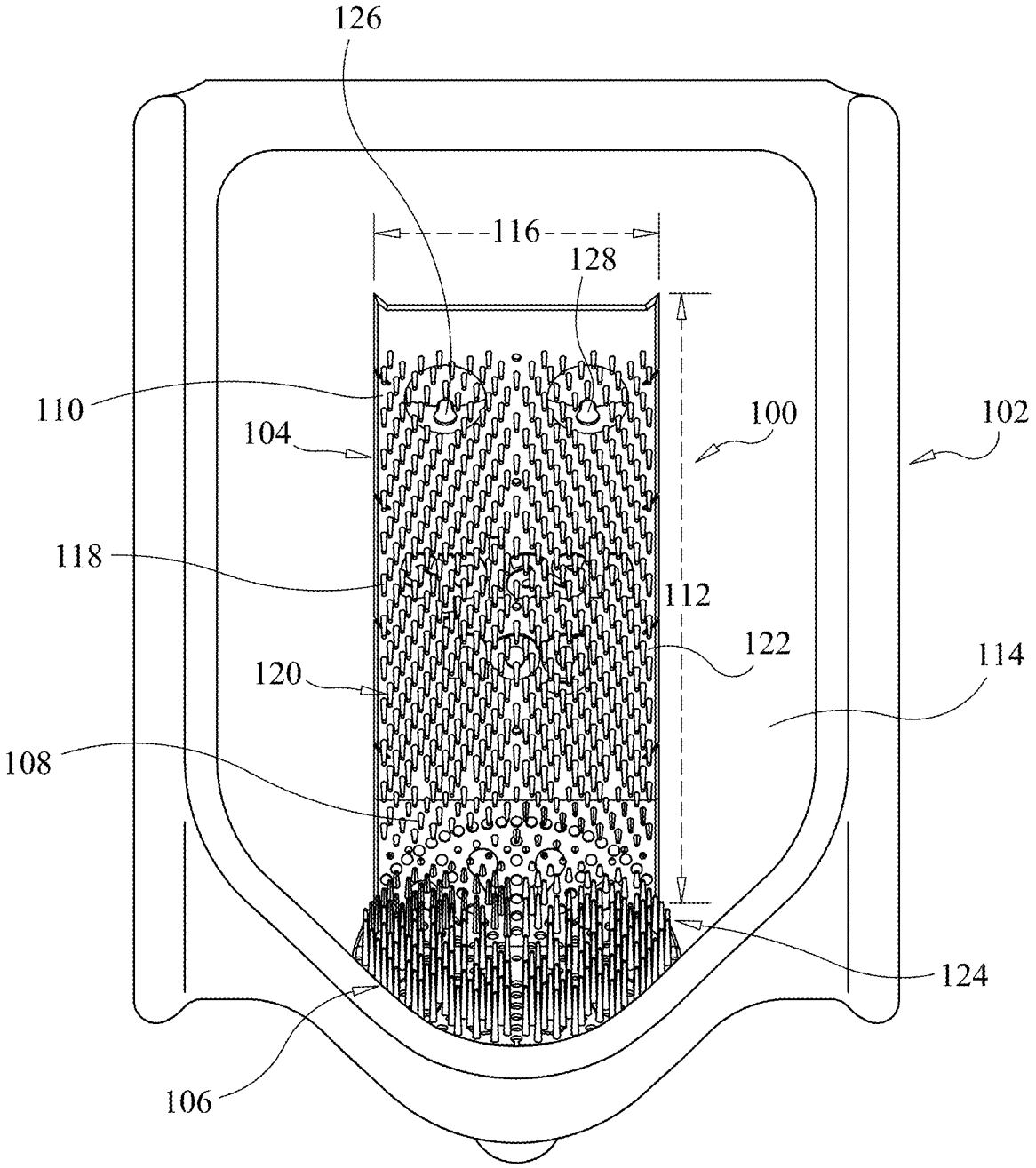
FIG. 1 is an elevational front view of a urinal anti-splash device disposed in a urinal, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient urinal anti-splash device that prevents urine from splashing onto a user when the urine is deposited on the urinal wall, e.g., the urinal back wall, or in a direction toward the urinal drain. Advantageously, the urinal anti-splash device includes an anti-splash body and a base that may be separated from each other to provide a device that conforms to various types of urinals, while simultaneously covering a substantial portion of the overall surface area of the urinal. Embodiments of the invention also provide one or more protrusions that substantially span a longitudinal length of the anti-splash body and define one or more protrusion voids which allow the urine to flow in the direction toward the urinal drain.

Referring now to FIG. 1, one embodiment of the present invention is shown in an elevational front view. FIG. 1 shows several advantageous features of the present invention, but, as will be described below, the invention can be provided in several shapes, sizes, combinations of features and components, and varying numbers and functions of the components. The first example of a urinal anti-splash device 100 placed within a urinal 102, as shown in FIG. 1, includes an anti-splash body 104 coupled to a base 106. In one embodiment, the anti-splash body 104 is sized and shaped to couple to at least a portion of a urinal 102, e.g., a standard sized urinal. The term "urinal" is defined herein in its broadest possible sense as a container or other receptacle normally found in a restroom and may include a standard sized adult urinal, a child's urinal, or the like. The urinal 102 may be of a shape that is, without limitation, rectangular, square, round, oval, or the like. It is understood that the urinal dimensions and shapes described herein are merely exemplary and not intended to be limiting.

In one embodiment, the portion of the urinal 102 configured to receive the anti-splash body 104 is a back wall 114 of the urinal 102. In one embodiment, the back wall 114 may include a height of approximately 17.0-22.0 inches in length and a width that is approximately 9.0-14.0 inches in length. In other embodiments, the urinal 102 may include a length and a width that is outside of this range.

FIG. 1 depicts the anti-splash body 104 having a first portion 108, a second portion 110 opposite the first portion 108, and a length 112, i.e., a longitudinal length, extending from the first portion 108 to the second portion 110. In one embodiment, the length 112 permits the anti-splash body 104 to cover a substantial portion of the back wall 114 of the urinal 102 to prevent urine from splashing on a user when the urine strikes the anti-splash body 104. The term "substantial portion" is defined herein as covering at least 40%-50% of the back wall 114 of the urinal 102. In other embodiments, the length 112 covers less than the substantial portion of the back wall 114 of the urinal 102.

In one embodiment, the anti-splash body 104 includes an elongated shape of a flexible material configured to couple to the urinal 102. The term "elongated" is defined herein as having a length that is at least twice as long as a width. In other embodiments, the length may be less than twice as long as the width. For example, in one embodiment the length 112 is approximately 17.0-20.0 inches. In this embodiment, the anti-splash body may include a width 116 that is approximately 5.0-8.0 inches. In another embodiment, the length 112 may be approximately 13.0-16.0 inches and the width 116 may be approximately 3.0-6.0. In other embodiments, the length 112 and the width 116 may be outside of these ranges.

FIG. 1 depicts the elongated shape of the anti-splash body 104 being a rectangular-like shape. The term "rectangular-like" is defined herein as having at least one pair of opposing parallel sides of equal length. The term "rectangular-like" may encompass round or curved edges. In other embodiments, the anti-splash body 104 may be rectangular, square, round, oval, or another shape conducive for coupling to the back wall 114 of a urinal 102.

In one embodiment, the anti-splash body 104 may be made of a material that is flexible and tough, such as DuPont Elvax®250, PVC plastic, or the like. In other embodiments, the anti-splash body 104 may be composed of a composite material, a metallic material, or another material conducive for placement within a urinal. The material may or may not have elastically deformable properties (e.g., the ability to change its shape and return back to its static-state shape after its change in shape). In one advantageous embodiment, the material is a buoyant material that provides a base 106 that will rise above the water line where water remains in the urinal after flushing, thereby decreasing the risk of the urinal drain being blocked by the anti-splash device 100. In other embodiments, the material may be a non-buoyant material.

In one embodiment, the urine is prevented from splashing onto the user when striking the anti-splash body 104 at least partly due to a first plurality of protrusions 118 being coupled to an front surface 120 of the anti-splash body 104. The term "protrusion" is defined herein as a part that extends away from the front surface 120 and may include bristles, a wave pattern, one or more shapes, e.g., squares, or another configuration designed to prevent urine from splashing onto a user when using the anti-splash device 100. In use, such as when a urine stream strikes the protrusions 118, the urine may be broken apart by the protrusions 118. Said another way, the anti-splash device 100 may not rely on a capillary action to reduce or prevent urine from splashing from the anti-splash device 100 onto a user.

Advantageously, the protrusions 118 define a plurality of protrusion voids 122 which permit the urine to effectively flow in a downward direction along the front surface 120 toward the lower portion 124 of the urinal 102 which houses the urinal drain. In one embodiment, such as when the device 100 is disposed in a vertical direction with respect to the back wall 114 of the urinal 102, gravity may assist in causing the urine to effectively flow in the downward direction toward the lower portion 124 of the urinal 102. The protrusion voids 122 may also provide space for the protrusions 118 to bend and deflect when struck by the urine.

In order to effectively mount the anti-splash body 104 to the back wall 114, the anti-splash body 104 includes at least one fastener 126 sized and shaped to orient the anti-splash body 104 in the vertical direction parallel to a vertical direction of the back wall 114. FIG. 1 depicts the anti-splash body 104 mounted to the back wall 114 using a first suction cup coupled to the fastener 126 and a second suction cup coupled to a second fastener 128. The fasteners 126, 128 are depicted as apertures defined by the anti-splash body 104. In other embodiments, the fasteners 126, 128 may be adhesive, e.g., tape, hooks, or another type of fastener configured to mount the anti-splash body 104 in a stationary position relative to the back wall 114.

Figure 2:
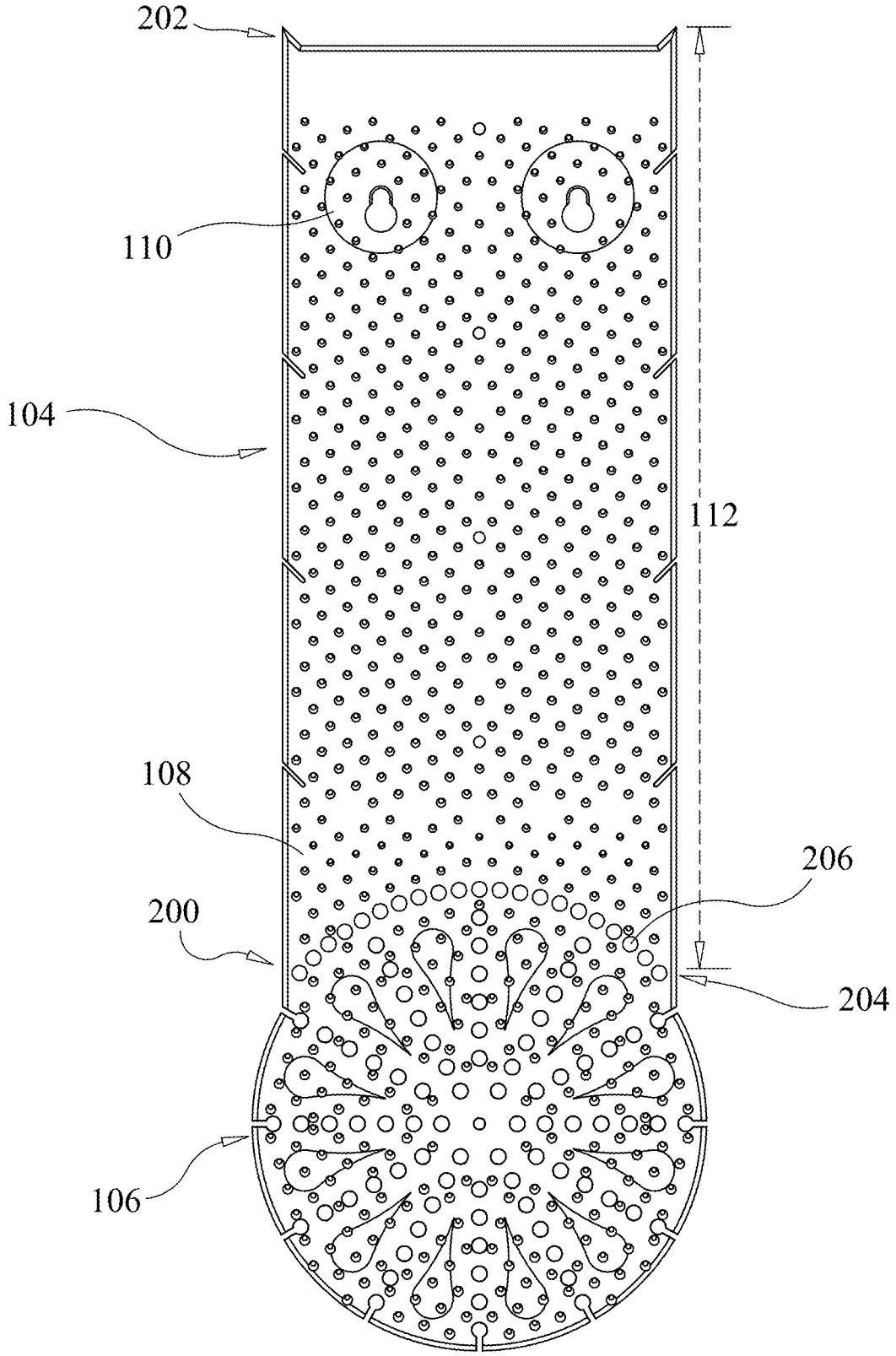
FIG. 2 is an elevational front view of the urinal anti-splash device of FIG. 1 disposed outside of a urinal and depicting a base disposed in a direction substantially parallel to an anti-splash body, in accordance with some embodiments.

With reference now to FIG. 2, the base 106 is depicted as being coupled to the first portion 108 of the anti-splash body 104. Generally speaking, the first portion 108 includes the region extending approximately from a first end 200 to a midpoint along the length 112. In the same vein, the second portion 110 includes the region extending approximately from a second end 202 to the midpoint along the length 112. The midpoint is generally defined as being disposed approximately halfway between the first end 200 and the second end 202.

Figure 3:
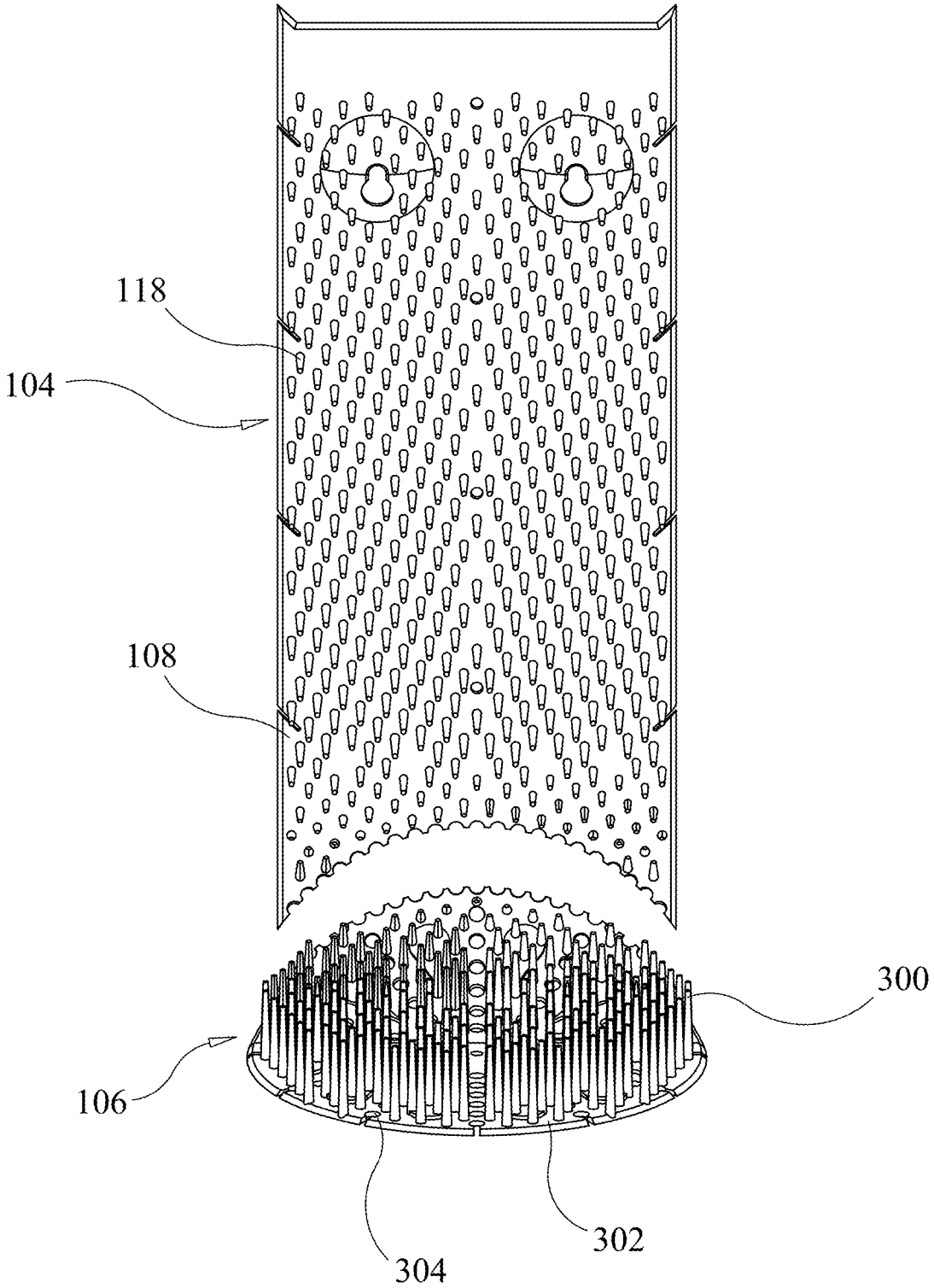
FIG. 3 is an elevational front view of the urinal anti-splash device of FIG. 1 depicting the base uncoupled from and disposed in a direction substantially perpendicular to the anti-splash body, in accordance with some embodiments.

With brief reference to FIG. 2, in conjunction with FIG. 3, in one advantageous embodiment, in order to effectively separate, e.g., removably couple, the anti-splash body 104 from the base 106 (FIG. 3), the first end 200 includes a perforated coupling region 204 disposed between the first portion 108 and the base 106. More specifically, the perforated coupling region 204 extends from the first portion 108 to the base 106 and includes a perforated edge 206 that facilitates in the ability to simply tear, split, or otherwise separate the first portion 108 of the anti-splash body 104 from the base 106 along the perforated edge 206. The term "perforated" is defined herein as visibly displaying a hole, perforation, puncture, or other visible marking such that the user is provided with a visual indication of where the anti-splash body 104 may be uncoupled, i.e., separated, from the base 106. Said another way, the anti-splash body 104 may be removably coupled from the base 106. Advantageously, the perforated coupling region 204 not only allows the user to remove the base 106 from urinals with raised drainage points, but it also provides the user with the ability to independently move and position the anti-splash body 104 and the base 106 relative to select locations on a urinal.

In one embodiment, the perforated coupling region 204 is configured to translate the base 106 from a first position in which the base 106 is oriented in a direction parallel to the anti-splash body 104 (FIG. 2) to a second position including the base 106 being oriented in a direction substantially perpendicular from the first portion 108 of the anti-splash body 104 (FIG. 3). The term "substantially perpendicular" is defined herein as being disposed at an approximate 90 orientation (+/−15-20°) with respect to the first portion 108. The base 106 may be translated from the first positon to the second positon when coupled to the anti-splash body 104 or alternatively, when separated from the anti-splash body 104.

With reference again to FIG. 1, the substantially perpendicular orientation of the base 106 enables the user to bend the urinal anti-splash device 100 in accordance with the dimensions of the urinal. In the same vein, this embodiment provides the urinal anti-splash device 100 that covers the urinal's back wall 114 and lower portion 124, thereby reducing or preventing urine from splashing on the user when either or both the back wall 114 and the lower portion 124 are struck by a stream of urine. As an added advantage, the urinal anti-splash device 100 may be made from a single mold, effectively reducing the costs associated with making the urinal anti-splash device 100 in comparison to other existing urinal accessories that may require the manufacturing of separate components. In other embodiments, the anti-splash device 100, e.g., the anti-splash body 104 and the base 106, may be manufactured as separate components.

With reference now to FIG. 3, a second plurality of protrusions 300 can be seen extending outwardly from the base 106. The second plurality of protrusions 300 are configured to extend in the direction substantially perpendicular from the first portion 108 of the anti-splash body 104. This configuration advantageously prevents urine from splashing onto the user when striking the base 106. Similar to the protrusions 118 described above, in use, such as when a urine stream strikes the protrusions 300, the urine may be broken apart by the protrusions 300. Advantageously, the protrusions 300 define a plurality of protrusion voids 302 which permit the urine to effectively flow in the downward direction toward the urinal drain. In order to effectively allow the urine to flow into the urinal drain, the base 106 is depicted as defining a plurality of apertures 304 which define a urine flow path from the base 106 to the urinal drain. The protrusion voids 302 may also give space for the protrusions 300 to bend and deflect when struck by the urine.

Figure 4:
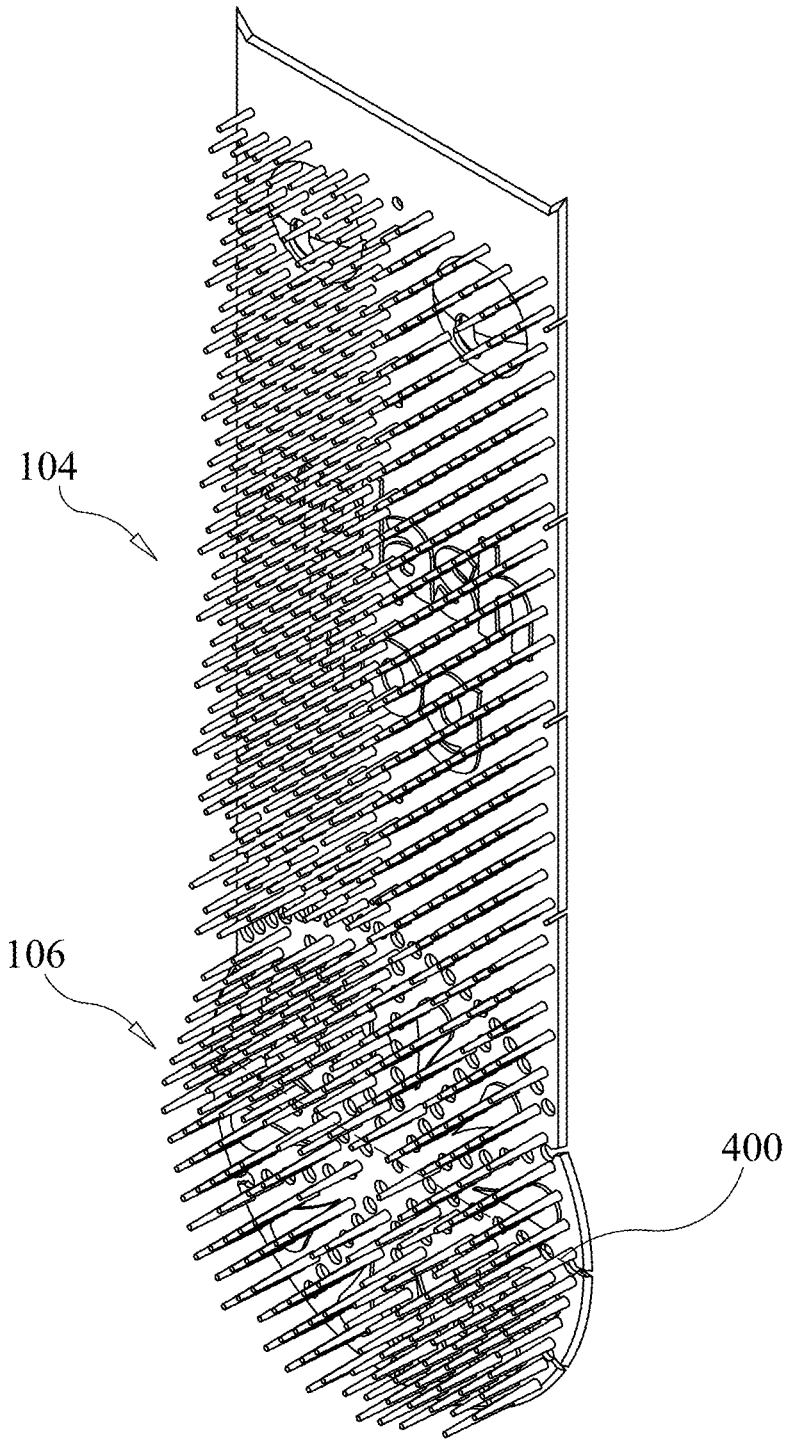
FIG. 4 is a perspective view of the urinal anti-splash device of FIG. 1 depicting further features of the base, in accordance with some embodiments.

With reference now to FIG. 4, in order to prevent urine from bouncing off of the urinal drain screen in a direction toward the user, the base 106 is sized and shaped to cover at least a portion of the surface area of a urinal drain screen. In one embodiment, the portion may be at least 30% of the surface area of the urinal drain screen. In other embodiments, the base 106 may cover less than the 30% of the surface area of the urinal drain screen. In one non-limiting embodiment the base 106 includes a diameter 400 that is approximately 5.0-7.0 inches in length. In others embodiments, the diameter 400 may be outside of this range.

FIG. 4 depicts the shape of the base 106 as being a circular-like shape, i.e., different than the shape of the anti-splash body 104. The term "circular-like" is defined herein as having at least two round edges. The circular-like shape is conducive for covering the urinal drain which is commonly a circular shape. In other embodiments, the shape of the base 106 and the shape of the anti-splash body 104 may be the same, e.g., rectangular, circular, square, round, oval, or another shape conducive for fitting within the urinal.

Figure 5:
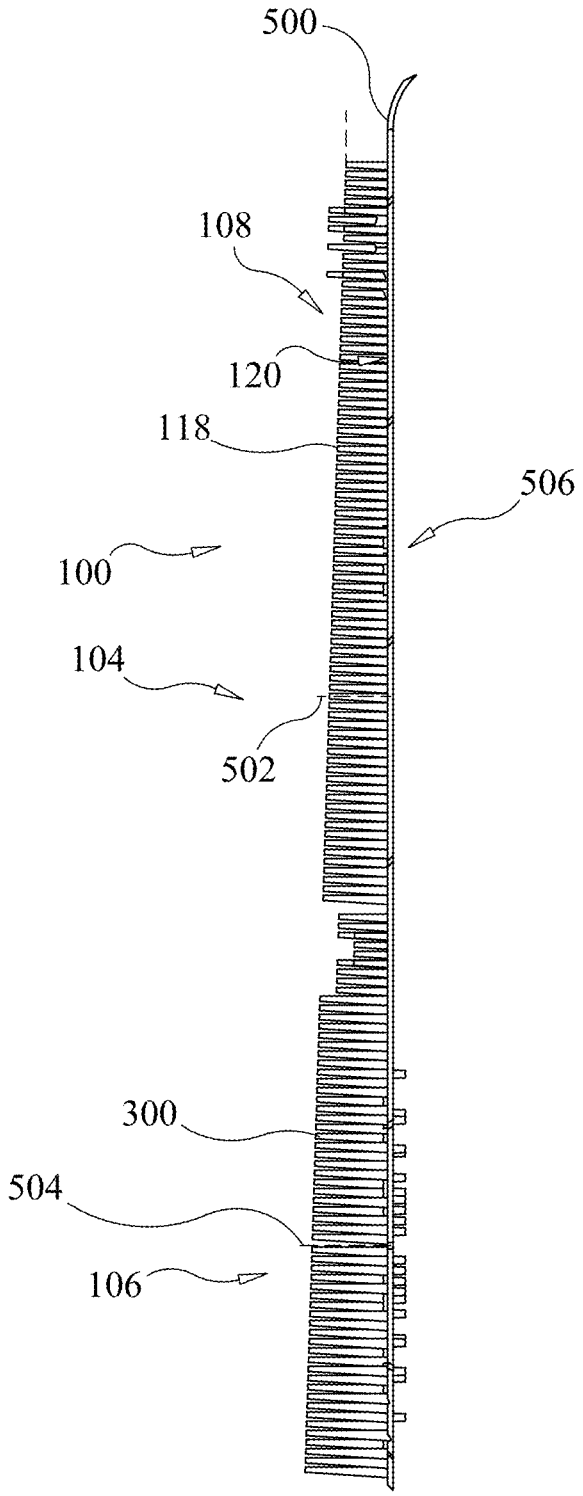
FIG. 5 is an elevational side view of the urinal anti-splash device of FIG. 1 depicting a plurality of protrusions of a variable length, in accordance with some embodiments.

With reference now to FIG. 5, an elevational side view of the urinal anti-splash device 100 is shown. More specifically, the first portion 108 is depicted having an angled region 500 to facilitate water and/or urine flow along the front surface 120 in a direction toward the urinal drain. Additionally, the protrusions 118, 300 are depicted as having a variable length which may also increase the facilitation of water and/or urine flow along the front surface 120 toward the urinal drain. In other embodiments, the protrusions 118 and/or the protrusions 300 may have a uniform length. In one embodiment, the protrusions 118 include a protrusion length 502 that is between approximately 0.25 to 1.0 inch. In other embodiments, the protrusion length 502 may be outside of this range. In the same vein, in one embodiment, the protrusions 300 include a protrusion length 504 that is the same as the protrusion length 502. In other embodiments, the protrusion length 504 may be outside of this range, e.g., between approximately 0.50 to 1.5 inches.

The protrusions 118, 300 can be seen tapering downwardly in a direction toward the front surface 120 of the anti-splash body 104 and the base 106 to further facilitate the water and/or urine flow. Said another way, the protrusions 118, 300 are wider at the location of the base than at the top. Such configuration causes the protrusions 118, 300 to break up the urine, while simultaneously allowing the urine to strike the front surface 120 and travel in the downward direction toward the drain when the urinal anti-splash device 100 is disposed in the vertical orientation. The tapering configuration also decreases the complexity associated with the manufacturing process of the device 100 because the protrusions 118, 300 may be relatively simply removed from the molding during the manufacturing process due to the lack of edges. In another embodiments, either the protrusions 118 or the protrusions 300 may include the tapering configuration. In other embodiments, the protrusions 118, 300 may be of a uniform width and devoid of the tapering configuration.

In one embodiment, the urinal anti-splash device 100 may include a fragrance embedded within the material of the urinal anti-splash device 100 during the manufacturing process, e.g., during the extrusion or molding phase of the manufacturing process. In another embodiment, the fragrance may be added to the material using a film process. The fragrance may be a volatile substance, such as a fragrant oil, an odor neutralizer, or the like. Such advantageous embodiments eliminate the need for the use of a room deodorizer or urinal cake that may be inconvenient and costly to consistently replace.

Figure 6:
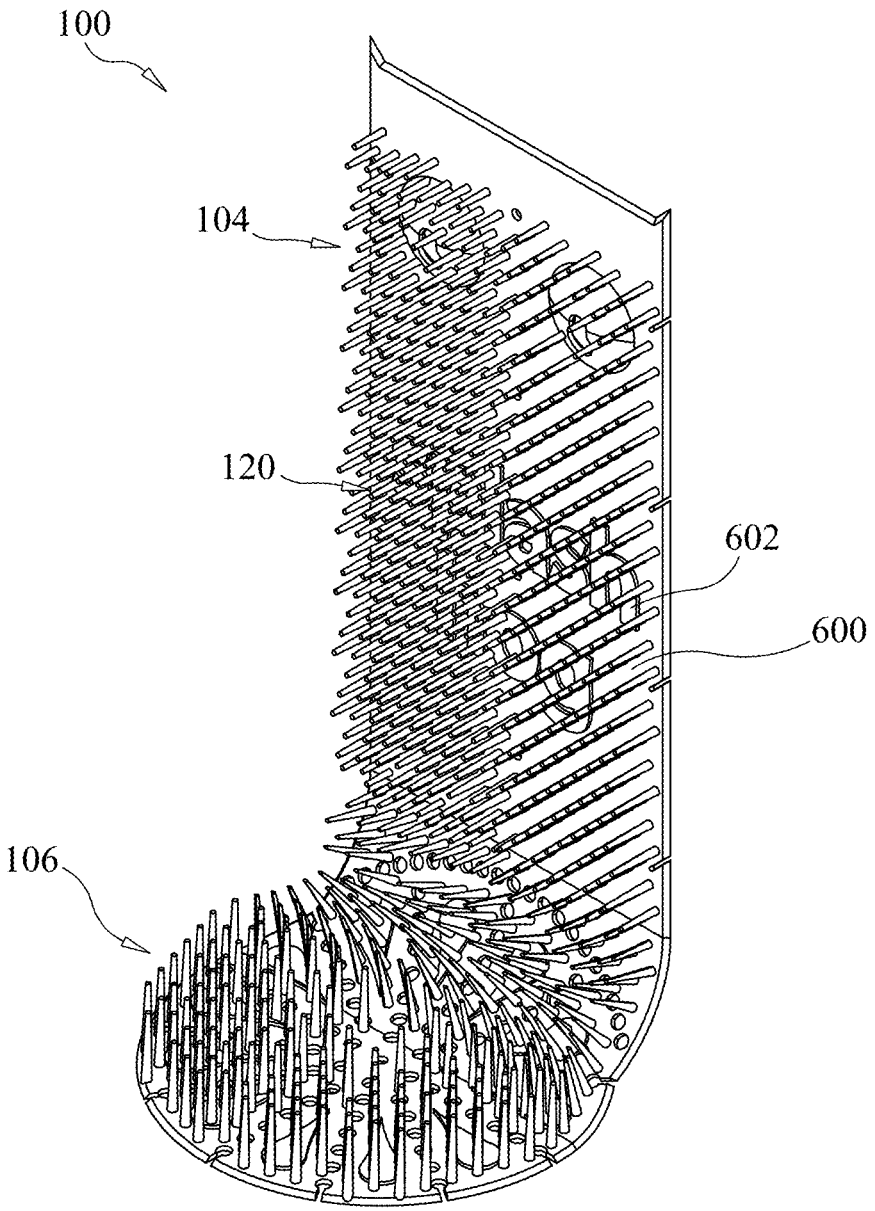
FIG. 6 is a perspective view of the urinal anti-splash device of FIG. 1 depicting the urinal anti-splash device having a thermochromic material added to the urinal anti-splash device, in accordance with some embodiments.

With reference now to FIG. 6, the anti-splash body 104 is depicted as being coupled to and in the substantially perpendicular orientation relative to the base 106. In one embodiment, the anti-splash body 104 and/or the base 106 made be made with a thermochromic material 600. More specifically, a layer of thermochromic dye may be added to the front surface 120 of the anti-splash body 104. In a preferred embodiment, the layer of thermochromic dye may be added to the front surface 120 of the anti-splash body 104 and the base 106. The thermochromic dye may be, without limitation, spirolactone, fluoran, spiropyran, or fulgide, as commonly used by those of ordinary skill in the art. In other embodiments, another type of material may be used to form the thermochromic material 600.

The thermochromic dye provides the user with the urinal anti-splash device 100 that changes color due to a change in temperature, e.g., that which occurs when urine strikes the thermochromic dye on the urinal anti-splash device 100. Advantageously, the thermochromic dye is not only aesthetically appealing, but also allows a viewer, such as maintenance personnel, to observe rinse coverage and the flow of water in order to efficiently and effectively clean the anti-splash device 100. As an added advantage, such configuration also allows businesses to advertise an insignia 602, e.g., a business name and/or logo, which becomes visible when the anti-splash device 100 changes color during use.

Figure 7:
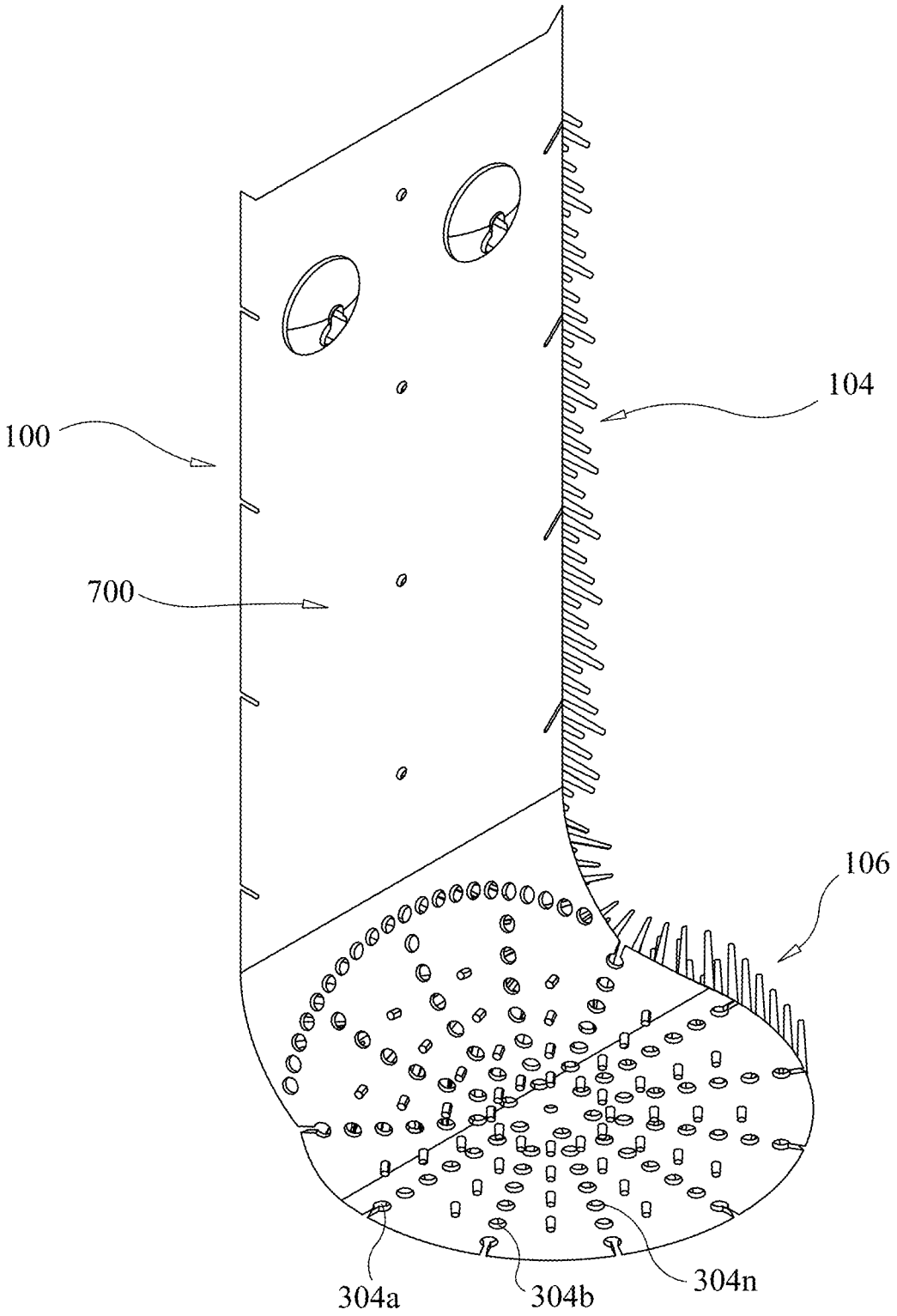
FIG. 7 is a perspective rear view of the urinal anti-splash device of FIG. 1 depicting the anti-splash body having a substantially level rear surface and the base defining a plurality of apertures, in accordance with some embodiments.

FIG. 7 depicts a perspective rear view of the device 100 showing the anti-splash body 104 having a rear surface 700 that facilitates in the anti-splash body 104 being flush with the back wall 114 of the urinal (FIG. 1). In one embodiment, the rear surface 700 is substantially level with the back wall 114 of the urinal. The term "substantially level" is defined herein as having a relatively flat surface with minimal sloping. In other embodiments, the rear surface 700 may include an uneven rear surface 700, although the level rear surface 700 is preferred.

To effectuate the flow of a stream of urine along the urine flow path from the base 106 in a direction toward the urinal drain, FIG. 7 depicts the apertures 304*a-n* arranged in a substantially linear configuration. The indicator "a-n" is intended to represent any number of items, with "a" indicating 1 and "n" indicating any number greater than 1. The term "substantially linear" is defined herein as arranged in a nearly straight line allowing nominal deviation. The substantially linear configuration of the apertures 304*a-n* forces the stream of urine and/or water to be directed toward the urinal drain. In another embodiments, the apertures 304*a-n* may be arranged in another configuration, e.g., in a deviating configuration with respect to each other.

Figure 8:
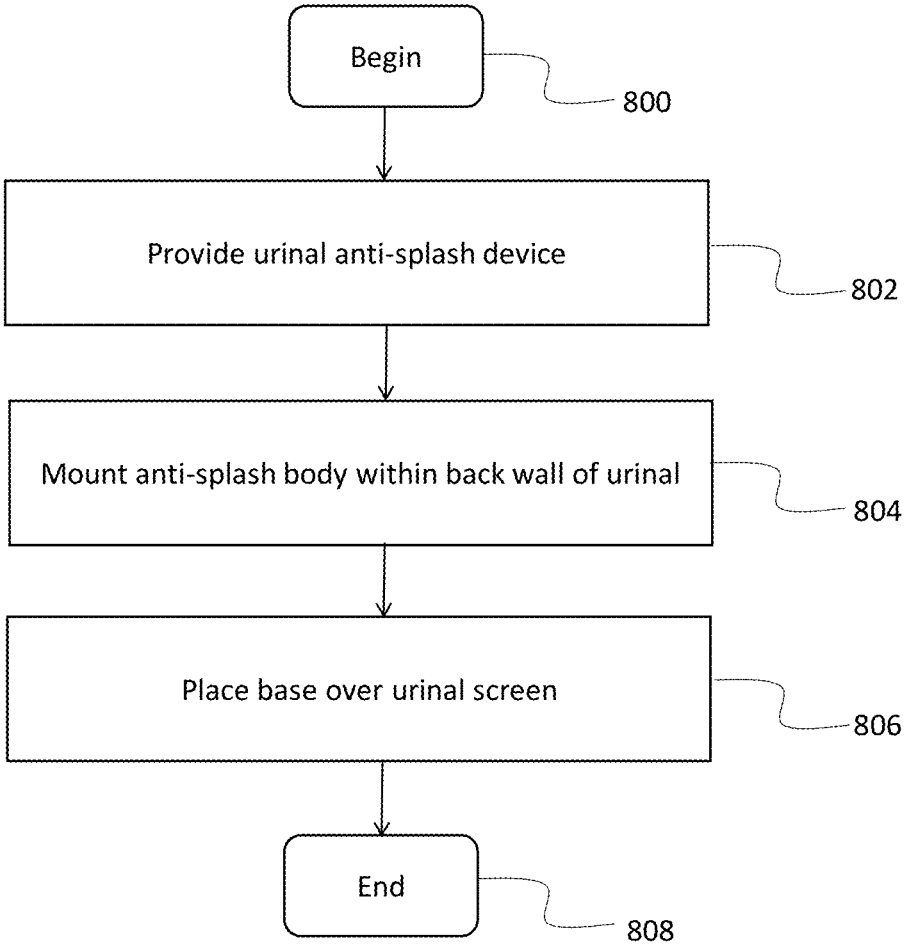
FIG. 8 is a process flow diagram depicting a method of mounting a urinal anti-splash device within a urinal, in accordance with some embodiments.

With reference now to the process flow chart of FIG. 8, in conjunction with FIGS. 1-7, an exemplary method of mounting a urinal anti-splash device within a urinal is shown. Although FIG. 8 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 8 for the sake of brevity. In some embodiments, some or all of the process steps included in FIG. 8 can be combined into a single process.

In said process, the method begins as step 800 and immediately proceeds to step 802 of providing a urinal anti-splash device, such as the urinal anti-splash device 100 described above. More specifically, in one embodiment, the urinal anti-splash device 100 includes the anti-splash body 104 coupled to the base 106. As discussed above, the anti-splash body 104 may also include the first plurality of protrusions 118 extending outwardly from the front surface 120 of the anti-splash body 104 and the second plurality of protrusions 300 extending outwardly from the base 106. The second plurality of protrusions 300 are configured to extend in the direction substantially perpendicular from the first portion 108 of the anti-splash body 104.

In step 804, the process continues with mounting the anti-splash body 104 within a back wall of a urinal. In one embodiment, such mounting may be performed using suctions cups coupled to at least one fastener disposed on the urinal anti-splash device 100. In other embodiments, another type of fastener, e.g., adhesive, tape, hooks, etc., may be used to mount the anti-splash body 104 within the urinal.

Next, the process continues to the step of 806 of placing the base 106 over a urinal screen. Advantageously, in one embodiment, the process includes removably coupling, i.e., separating, the base 106 from the anti-splash body 104 such that the components may be independently positioned within the urinal. Such advantageous embodiment provides the urinal anti-splash device 100 that is not only conducive for placement within different size and shape urinals, but also may cover a portion of the surface area of the urinal, to prevent urine from splashing onto a user. The portion of the surface area of the urinal covered by the anti-splash device 100 may depend on the overall size of the urinal and the relative dimensions of the urinal anti-splash device 100.

In another embodiment, the process may include bending the urinal anti-splash device 100 at a location of a perforated coupling region disposed between the first portion 108 of the anti-splash body 104 and the base 106, as discussed above. The perforated coupling region is configured to translate the base 106 from a first position parallel to the anti-splash body 104 to a second position including the base 106 being in the direction substantially perpendicular from the first portion 108 of the anti-splash body 104. In such configuration the base 106 may remain coupled to the anti-splash body 104, or alternatively, may be detached from the anti-splash body 104. The process then terminates at step 808.

Figure 9:
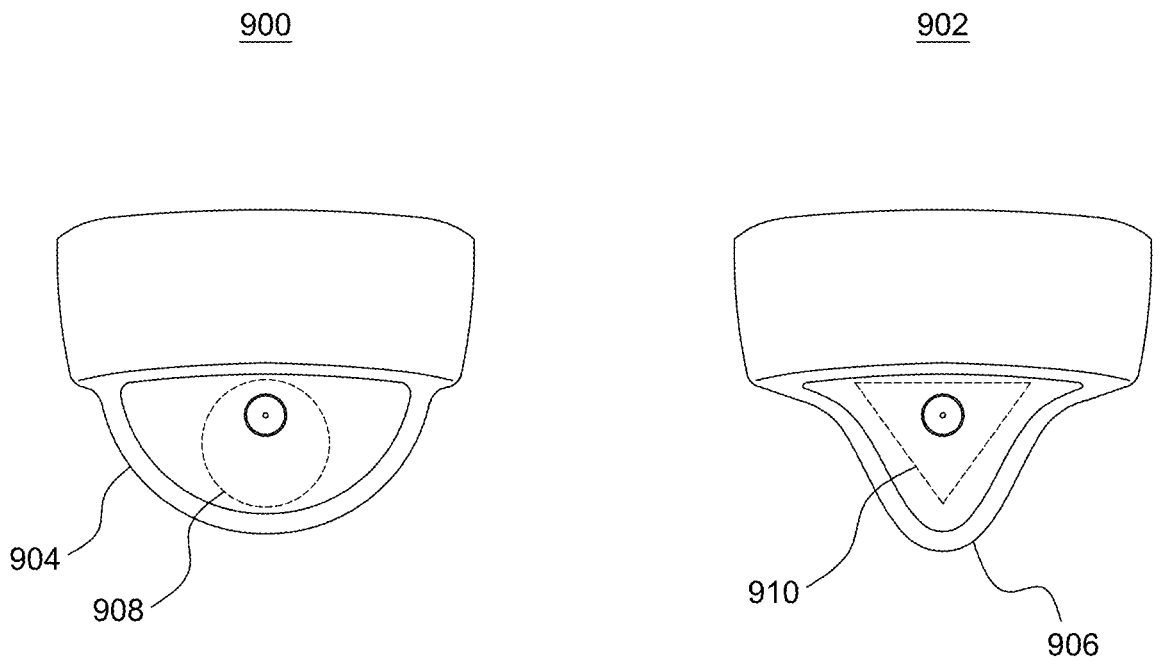
FIG. 9 is a top view of several urinals of various shapes, in accordance with the prior art.

FIG. 9 is a top view of several urinals of various shapes, in accordance with the prior art. Urinal 900 has a round basin 904 with a generally circular profile 908 in the circular basin 904. Urinal 902 has a pointed or triangular basin 906 with a pointed profile 910. The pointed basin 906 protrudes to a point at the front center of the basin. These two basins 904, 906 represent the more popular and common basin designs for urinals. Ordinarily a base, such as base 106, being round, would only be suited for using in urinal 900, and for urinal 902 a pointed base would be required. The same applies for standalone (e.g. not attached to an anti-splash body 104) devices intended to fit into a urinal basin. As a result, a manufacturer would have to produce two or four different anti-splash devices to fit in the different urinals.

Figure 10:
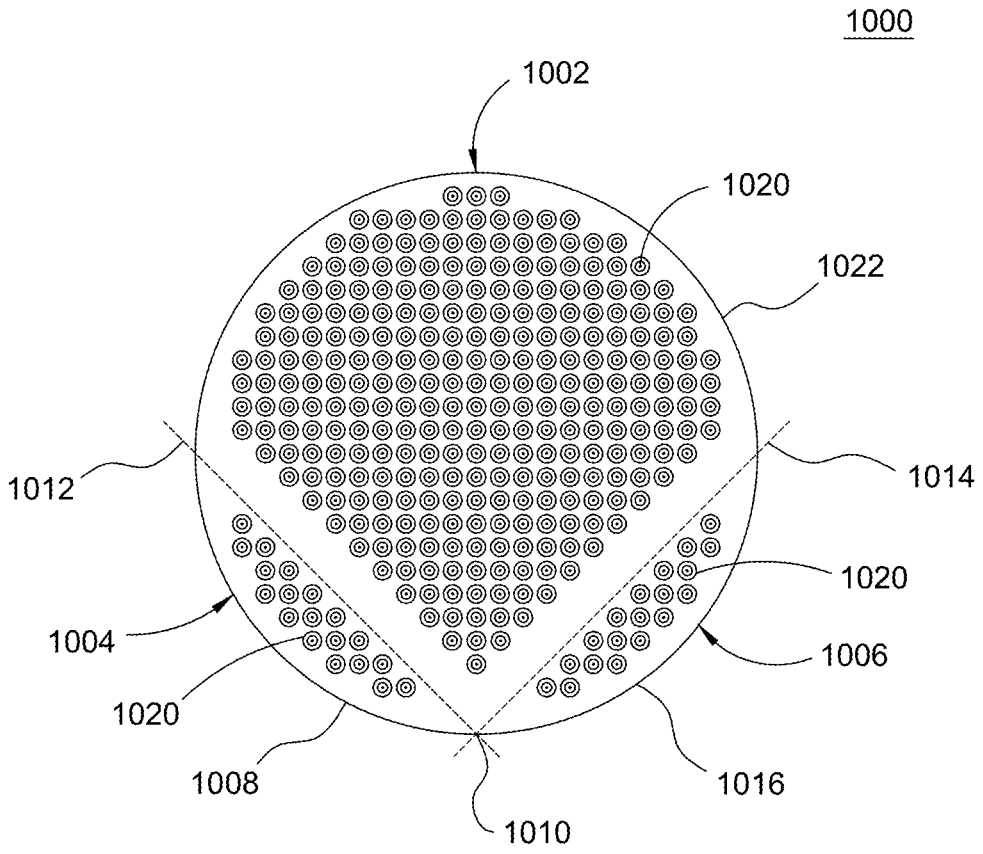
FIG. 10 is a top plan view of a urinal screen that is configurable for different urinal designs in a first configuration, in accordance with some embodiments.
Figure 11:
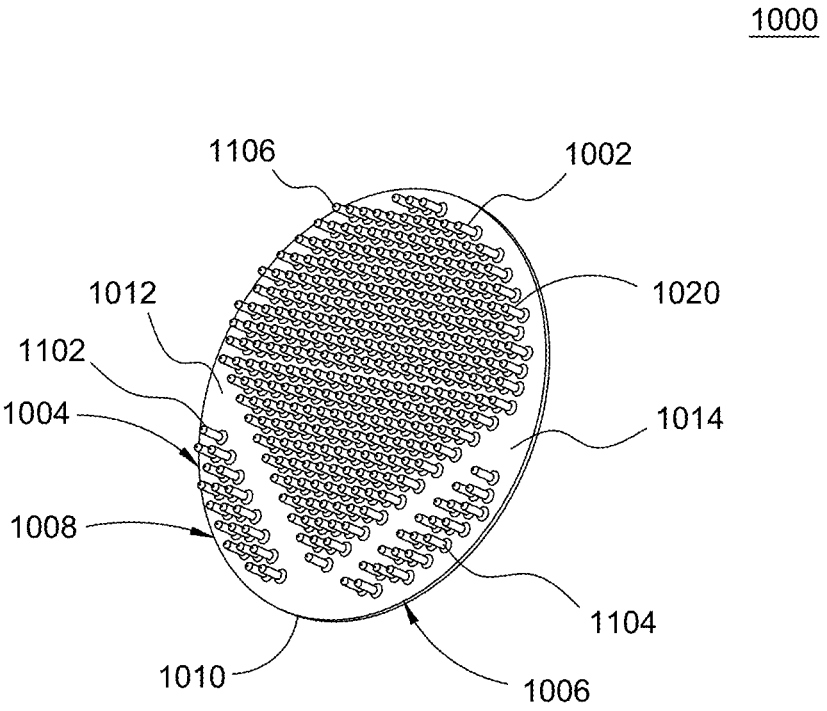
FIG. 11 is a perspective view from the top right of a urinal screen that is configurable for different urinal designs, in accordance with some embodiments.

FIG. 10 is a top plan view of a urinal screen 1000 that is configurable for different urinal designs (e.g. 900, 902) in a first configuration, in accordance with some embodiments. FIG. 11 is a perspective view of the urinal screen 1000. The urinal screen 1000 can be a standalone device as shown, or it can be the base portion of an anti-splash device having an anti-splash body that is configured to be mounted on the back vertical wall of a urinal. The urinal screen 1000 comprises a flat body 1002 that has a generally circular configuration, and the top side (in view here) of the body includes a plurality of upward (i.e. out of the page as shown here) pointing protrusions 1020. The body 1002 is made of a flexible material, such as DuPoint Elvax®250, PVC plastic, or the like. The protrusions, which can be made of the same material and integrally molded with the body 1002, can be tapered as in FIG. 2, or they can be shaped differently (e.g. bristles, loops, etc.). However, there are two fold lines 1012, 1014 along which there are no protrusions, so that the using screen is thereby configured to fold along these lines 1012, 1014. The lines 1012, 1014 run from opposing sides of the body 1002 and meet at a front point or front 1010 of the body 1002 which is at a rounded forward portion. The lines 1012, 1014 thereby define a first front portion 1004 and a second front portion 1006. The first front portion 1004 is defined between line 1012 and a first front edge portion 1008, and the second front portion is defined between line 1014 and a second front edge portion 1016. The first and second front edge portions 1008, 1016 are portions of the edge of the body 1002. On both the first front portion 1004 and the second front portion 1006 there are protrusions formed, such as those formed on the main body portion 1022 of the body 1002. The widths of the first line 1012 and second line 1014 can be one quarter to three quarters of an inch in some embodiments.

Figure 12:
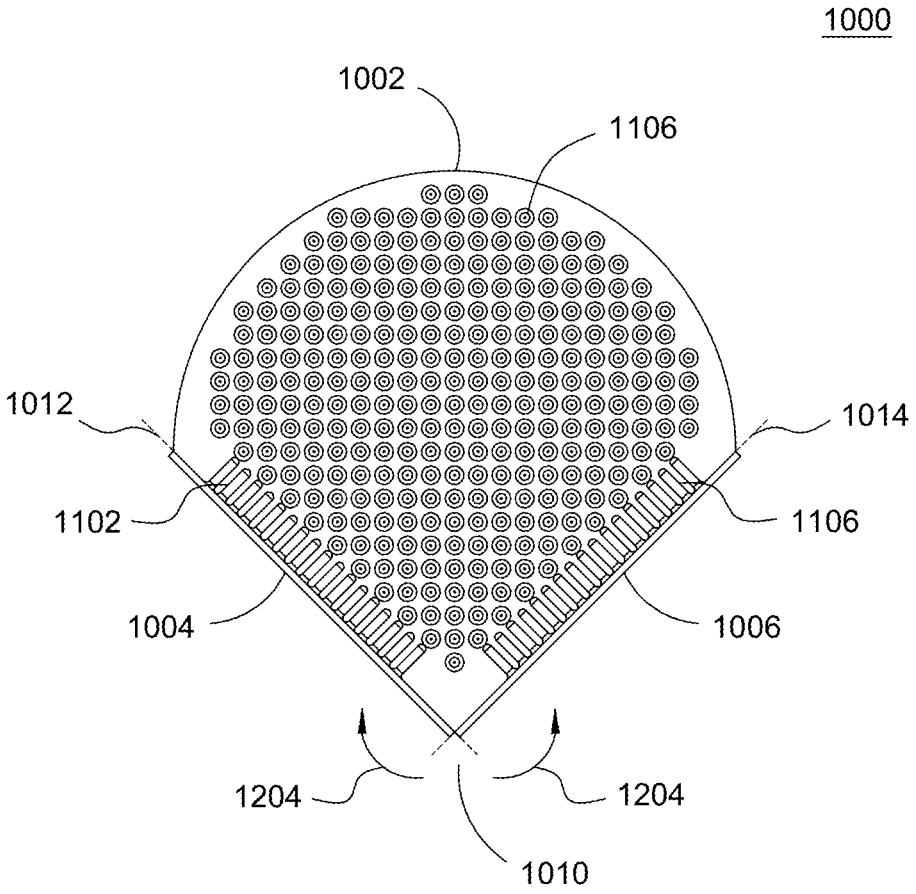
FIG. 12 is a is a top plan view of a urinal screen that is configurable for different urinal designs in a second configuration, in accordance with some embodiments.

The lack of protrusions 1020 along lines 1012, 1014 allow the body 1002 to be folded along these lines 1012, 1014 so that first front portion 1004 and second front portion 1006 can be folded upwards, as shown in FIG. 12 and as indicated by arrows 1204, thereby reconfiguring the body 1002 into a pointed configuration so that the body 1002 can fit into a pointed urinal basin. When folded into the pointed configuration, then, the undersides of the first front portion 1004 and the second front portion 1006 will rest against the vertical side walls of the pointed urinal basin. In some embodiments it is contemplated that the lines 1012, 1014 can be perforated so that first front portion 1004 and second front portion 1006 can be ripped off the body 1002, leaving the main body portion 1022 with a pointed section at the front 1010. In FIG. 11, showing a perspective view of the urinal screen 1000, there can be seen a plurality of protrusions 1102 on the first front portion 1004, a plurality of protrusions 1104 on the second front portion 1006, and a plurality of protrusions 1106 on the main body portion 1022.

Figure 13:
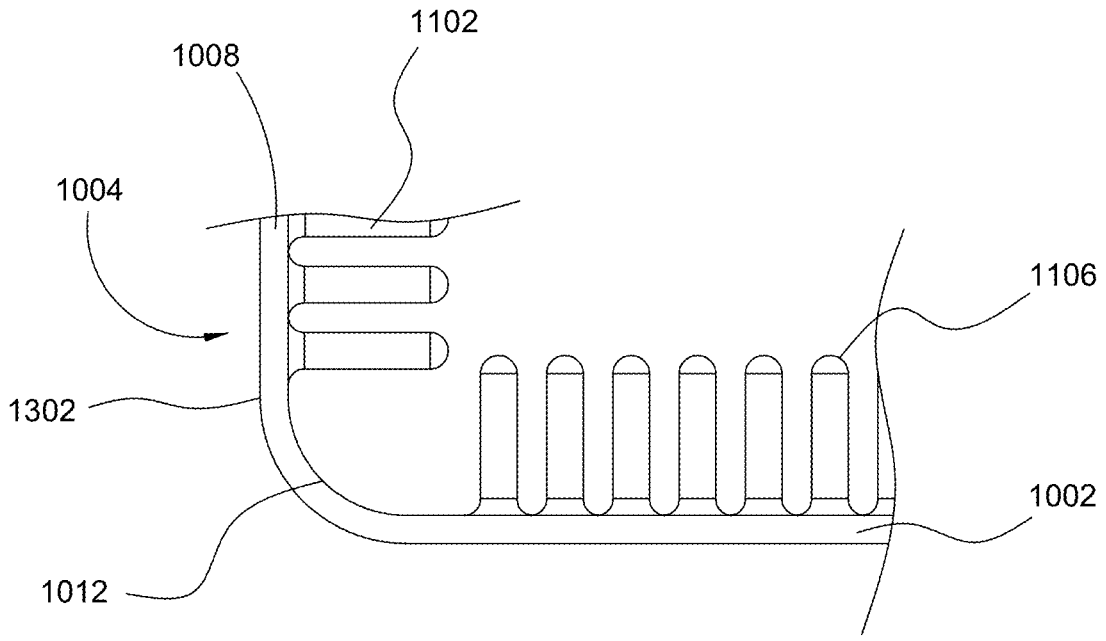
FIG. 13 is a side view, looking along a fold line, of a urinal screen that is configurable for different urinal designs in a folded configuration, in accordance with some embodiments.

FIG. 13 is a side view, looking along fold line 1012, of a urinal screen 1000 that is configurable for different urinal designs in a folded configuration, in accordance with some embodiments. From this view the body 1002 is horizontal and the first front portion 1004 can be seen folded up, vertical to the body 1002, configured for use in pointed urinal basins. The lack of protrusions along line 1012 (going in and out of the page as shown here) allows the first front portion 1004 to be folded or lifted up, such that the underside 1302 would rest against the vertical wall of the urinal basin while the rest of the body 1002 will rest on the bottom of the urinal basin with the front 1010 oriented into to peak or point of the urinal basin.

Figure 14:
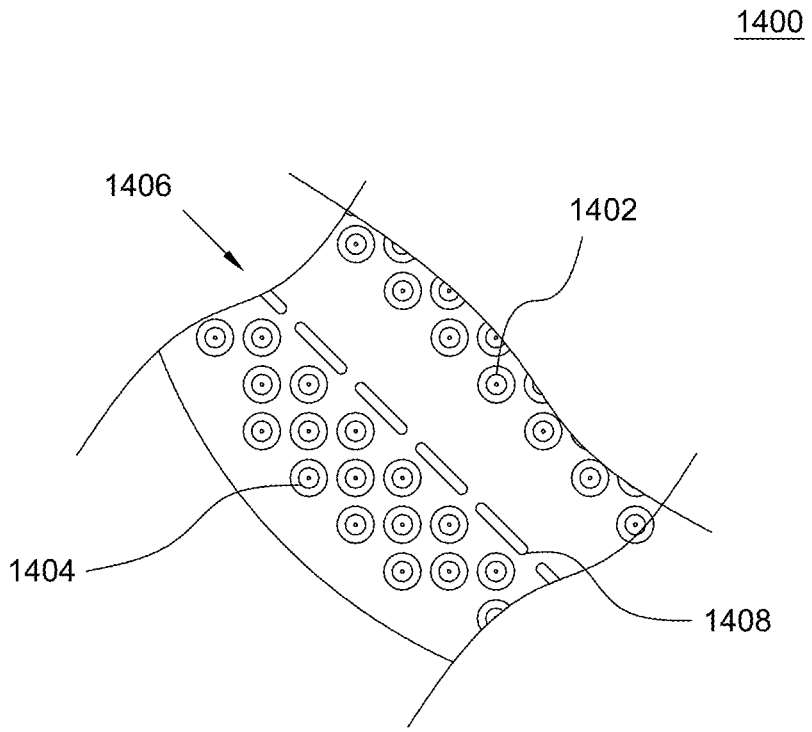
FIG. 14 is a top plan view of a portion of a urinal screen showing a fold line having perforations to facilitate folding along the fold line, in accordance with some embodiments.

FIG. 14 is a top plan view of a portion 1400 of a urinal screen showing a fold line 1406 having perforations 1408 to facilitate folding along the fold line 1406, in accordance with some embodiments. The fold line 1406 separates the main body portion 1402 from a front portion 1404, and both sides (the main body portion 1402 and front portion 1404) contain a plurality of protrusions. The perforations 1408 can facilitate removal of the front portion 1404 to reconfigure the urinal screen from a round configuration to a pointed configuration.

Figure 15:
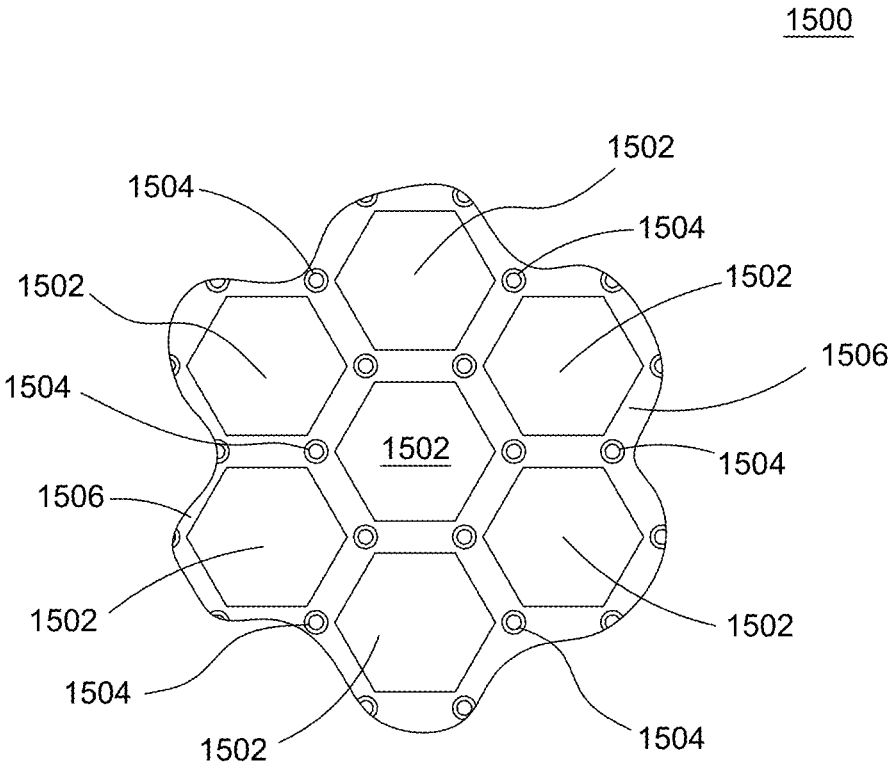
FIG. 15 is a detail of a body portion of a urinal screen that is configurable for different urinal designs, in accordance with some embodiments.

FIG. 15 is a detail of a body portion 1500 of a urinal screen that is configurable for different urinal designs, in accordance with some embodiments. The body portion 1500 can be used in any of the urinal screen designs of FIGS. 1-7 and 9-14. In general, the body is made of a webbing 1506 having hexagonal openings 1502. At the corners of each hexagonal opening 1502, on the webbing 1506, there is a protrusion 1504. The webbing 1506 can be used across the majority of the urinal screen, except at the edges, along fold lines (e.g. 1012, 1014), or along perforation lines (e.g. 206, 1408). The hexagonal openings allow fluid to pass through the urinal screen, and in that way the webbing 1506 can further prevent splash that might otherwise occur.

Figure 16:
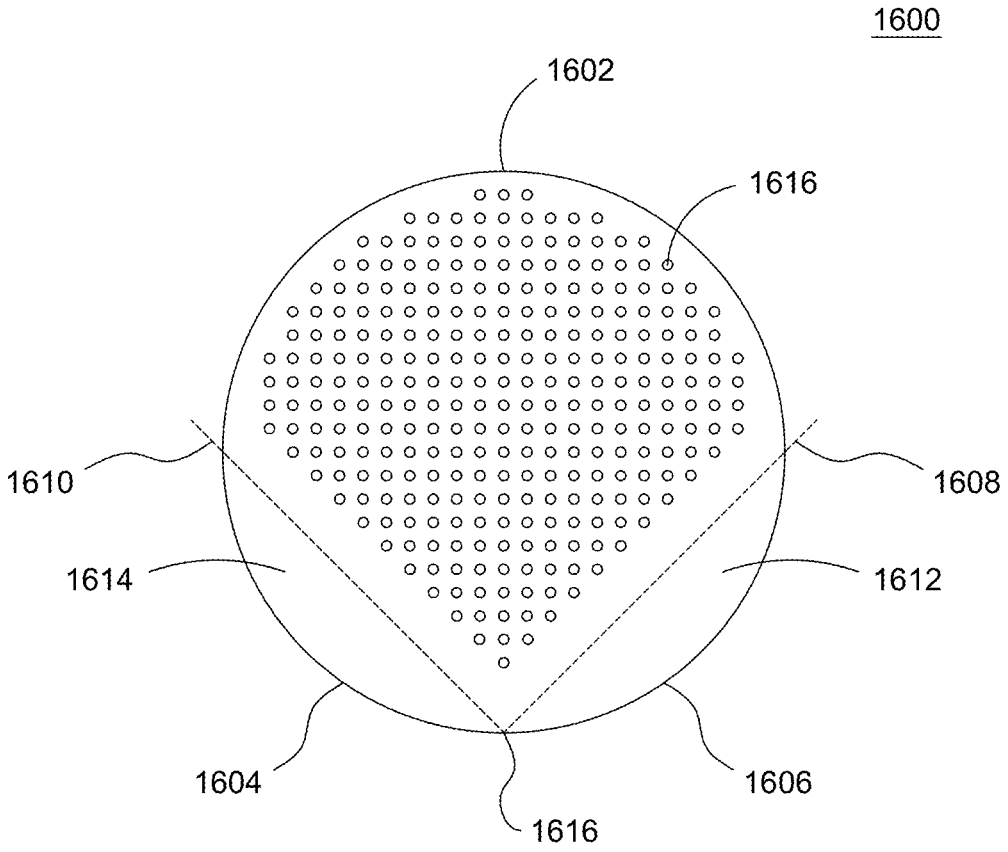
FIG. 16 is a bottom plan view of a urinal screen that is configurable for different urinal designs, in accordance with some embodiments.

FIG. 16 is a bottom plan view of a urinal screen 1600 that is configurable for different urinal designs, in accordance with some embodiments. Urinal screen 1600 can be substantially the same as urinal screen 1000, and this view can simply be the underside of urinal screen 1000. The urinal screen 1600 includes a body 1602 that is generally circular in shape, and which can be made of a webbing (e.g. 1506) and can comprise protrusions 1616, which are shorter than the protrusion on the top side, opposite the view shown here of the bottom. A first front portion 1604 is defined by a first fold line 1610, and a second front portion 1606 is defined by a second fold line 1608. The fold lines 1610, 1608 join at a front 1616 of the body. The first front portion 1604 has bottom surface 1614 or underside that can lack protrusions, but the top side of the first front portion 1604 can include protrusions as in FIG. 10. Likewise with the second front portion 1606, the bottom surface 1612 can lack protrusions, but the top side of the second front portion 1606 can include protrusions as in FIG. 10. Upon being folded into a pointed configuration, by folding the first front portion 1604 and the second front portion 1606 into the page, along lines 1610, 1608, respectively, the urinal screen 1600 can then be used in pointed urinal basins.

Figure 17:
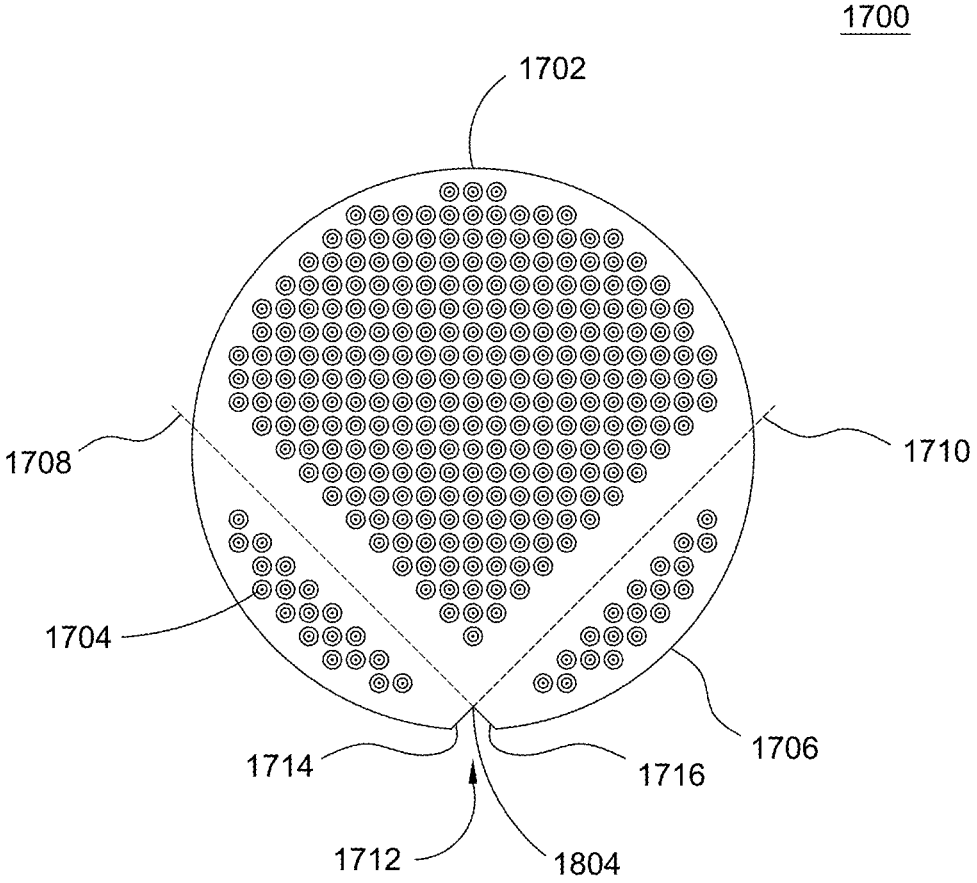
FIG. 17 is a top plan view of an alternative urinal screen that is configurable for different urinal designs in a first configuration, in accordance with some embodiments.

FIG. 17 is a top plan view of an alternative urinal screen 1700 that is configurable for different urinal designs, in accordance with some embodiments. The urinal screen 1700 includes a body 1702 that can be covered with protrusions for breaking up fluid streams and reducing or eliminating splash. The body has a first front portion 1704 and a second front portion 1706 that are defined by forl lines 1708 and 1710, respectively. The first front portion 1704 and the second front portion 1706 are, like the body 1702, covered with a plurality of protrusions, but the body 1702 lacks protrusions along the fold lines 1708, 1710. The fold lines 1710, 1712 can meet at a front of the body, and terminate at opposing sides of the body at other ends of the fold lines 1710, 1712. However, to facilitate folding, a notch 1712 can be formed or cut at the front. The notch 1712 can be V-shaped, and complementary to the angle formed by the fold lines 1708, 1710 with respect to each other. That is, one side of the V-shaped notch 1712 can be in line with fold line 1708, and the other side of the V-shaped notch 1712 can be in line with the other fold line 1712. The notch 1712 allows there to be more area on the first and second front portions 1704, 1706. Furthermore, when these front portions 1704, 1706 are folded up at right angles to the body 1702 the edges of the notch will be abutting each other as shown in FIG. 18.

Figure 18:
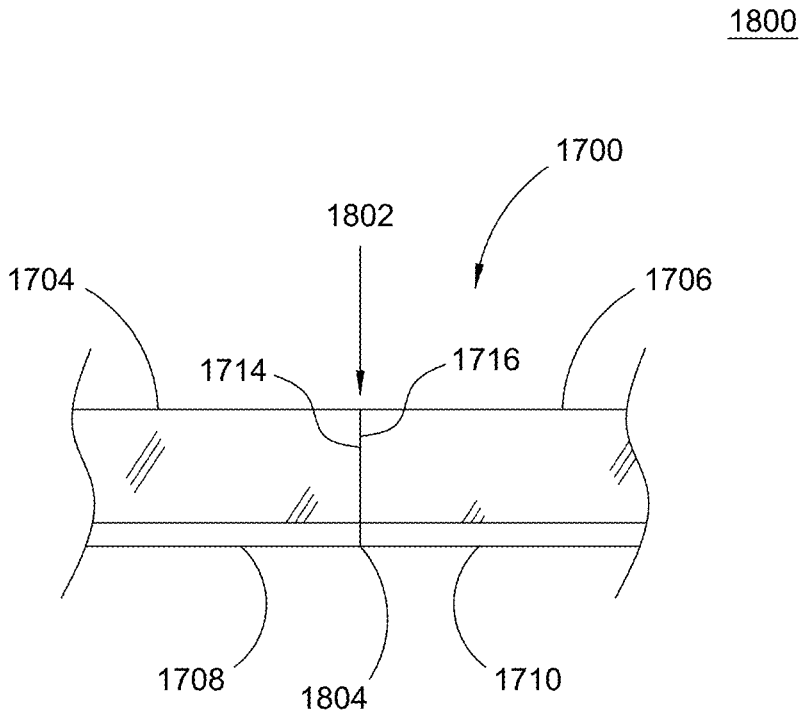
FIG. 18 is a side view of an alternative urinal screen that is configurable for different urinal designs in a second configuration, in accordance with some embodiments.

FIG. 18 is a side view 1800 of an alternative urinal screen 1700 that is configurable for different urinal designs in a second configuration, in accordance with some embodiments. In particular, the view shown here shows the first front portion 1704 and the second front portion 1706 folded up, similar to FIG. 10, so that the bottom or underside of these portions 1704, 1706 are seen here. The first front portion 1704 is folded along line 1708, which is therefore at the bottom of the first front portion 1704, and the second front portion 1706 is folded along line 1710, which is therefore at the bottom of the second front portion 1706. Due to the V-shaped notch 1712, however, the notch edges 1714, 1716 of the first front portion 1704 and the second front portion 1706, respectively, meet along vertical line 1802. The first front portion 1704 and second front portion 1706 meet at the peak 1804 of the V-shaped notch and upwards along line 1802.

Figure 19:
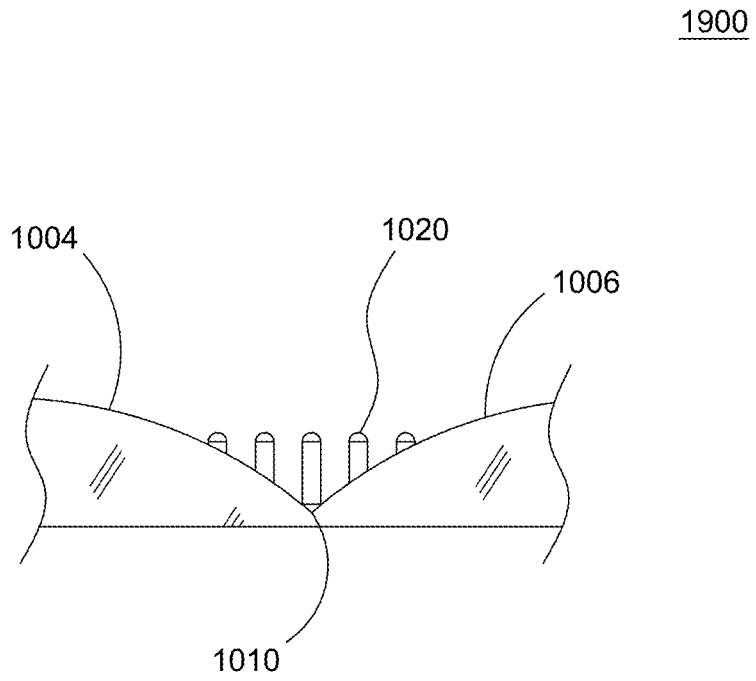
FIG. 19 is a side view of a urinal screen that is configurable for different urinal designs in a second configuration, in accordance with some embodiments.

FIG. 19 is a front side view 1900 of a urinal screen that is configurable for different urinal designs in a second configuration, in accordance with some embodiments. The urinal screen shown here can be that of FIG. 10, and thus similar reference numerals are used here. In this angle of view, as in FIG. 18, the view is looking from the side. The first front body portion 1004 and the second front body portion 1006 are folded up so that the front 1010 of the urinal screen is configured to a point or corner, or a pointed outline, rather than merely a continuation of a circular outline, as in FIG. 10.

Figure 20:
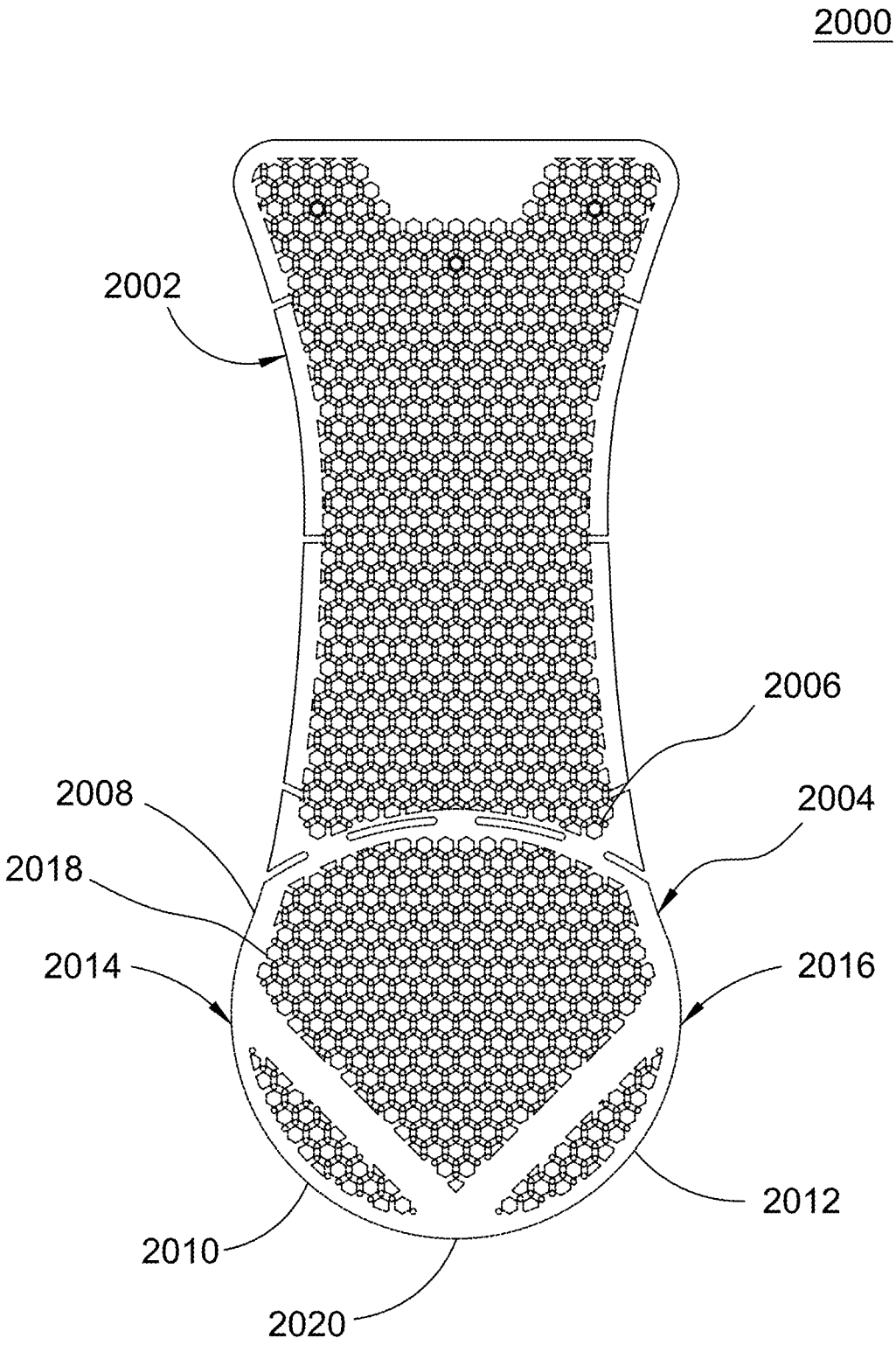
FIG. 20 is a front view of a urinal screen that is configurable for different urinal designs having a wall portion, in accordance with some embodiments.

FIG. 20 is a front view of a urinal screen 2000 that is configurable for different urinal designs having a wall portion, in accordance with some embodiments. The urinal screen 2000 shown here combines the anti-splash body 2002, which is substantially similar to that of FIGS. 1-2, with a base 2004 that is substantially the urinal screen design of FIG. 10. A coupling region, which can include perforations 2006, joins the anti-splash body 2002 and the base 2004 opposite the front of the base, but the two portions 2002, 2004 can be separated by tearing along the perforations. The base 2004 includes a main body portion 2008 a first front body portion 2010 and a second front body portion 2012. A plurality of protrusions 2018 substantially cover the main body portion 2008, the first front body portion 2010 and the second front body portion 2012. However, there is a lack of protrusion along first fold line 2014 and second fold line 2016. The first and second fold lines each have an end at opposite sides of the main body portion 2008, and meet at the front 2020. Thus, the urinal screen 2000 can be used to provide anti-splash protection at the rear wall of a urinal, by placing the anti-splash body 2002 against the back wall of the urinal (e.g. using suction cup mounts or equivalent), and the base 2004 can be used in either circular or pointed urinal basins.

Figure 21:
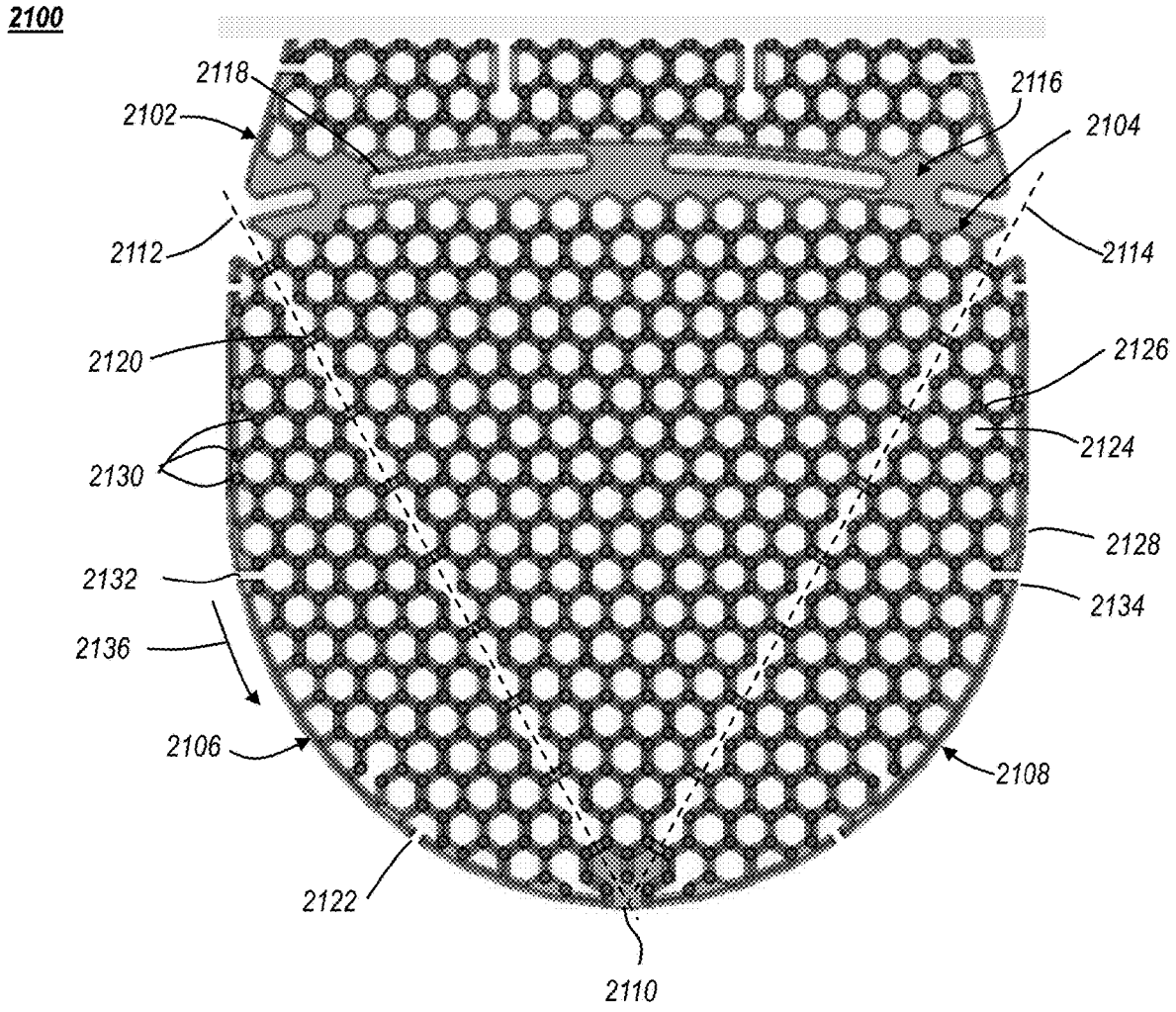
FIG. 21 is a top plan view of a urinal screen having a foldable base portion, in accordance with some embodiments.

FIG. 21 is a top plan view of a urinal screen 2100 having a foldable base portion, in accordance with some embodiments. The urinal screen is configured to have an anti-splash body 2102 (only partially shown here) and a base portion 2104. The base portion 2104 and the anti-splash body 2102 are separated by a coupling region 2116, along which there can be perforations 2118 that can aid in bending along the coupling region 2116, or allow a person to separate the base portion 2104 from the anti-splash body 2102. The anti-splash body 2102 is configured to be mounted vertically on a back wall of a urinal, and base portion 2104 is configured to placed horizontally in the basin of the urinal. The anti-splash body 2102 and the base portion 2104 are comprised of a layer of hexagonal or honeycomb webbing having hexagonal openings 2124 surrounded by connector links 2126. Of course, at the sides and in other places, not every opening 2124 is perfectly hexagonal, or completely surrounded by connector links. As shown here, the layer of webbing created by the connector links 2126 and the side components or edges (e.g. 2128), as well as the coupling region 2116 is generally a flat layer along the plane of the page as shown. At the verticies of the hexagonal openings 2124, where the connector links 2126 meet or intersect, forming intersecting portions, there are protrusions such as protrusion 2130 which extend perpendicular (e.g. out of the page as shown). Similarly, there can be protrusion on the back that extend in the opposite direction (e.g. into the page).

The base portion 2104 has a generally circular or arced forward edge (e.g. from 2132 to 2134 in the direction of arrow 2136), and includes a first front portion 2106 and a second front portion 2108 defined by fold lines 2112 and 2114, respectively. The first and second fold lines 2112, 2114 are shown each along a respective linear region along which the base portion is configured to fold. Specifically, the first front portion 2106 folds along the linear region along fold line 2112, and the second front portion 2108 folds along the linear region along fold line 2114. Along the fold lines 2112, 2114, which are configured along a series of in-line hexagonal openings, some of the connector links 2126 can be omitted. Furthermore, the connector links that cross from the first and second portions to the main body of the base portion 2104, such as connector link 2120, can have a reduced thickness in order to further facilitate folding the first and second front portions 2106, 2108. The fold lines 2112, 2114 each delineate a linear region that is configured to facilitate folding by having less material. In some embodiments that is simply a lack of protrusion, and, as shown here, the pattern of webbing is altered along the fold lines 2112, 2114 to have less material by omitting connector links across the fold lines 2112, 2114, and reducing the thickness of the remaining connector links that cross from the front portions 2106, 2108 to the main body between the fold lines 2112, 2114. Here, as an example, along the fold lines 2112, 2114, every other connector link is omitted. The fold lines 2112, 2114 meet at a front 2110 where the front edge can be open or reduced in thickness as well. The fold lines 2112, 2114 shown there start at opposite sides of the base portion 2104 near the opposite ends of the coupling region 2116, and meet at the front 2110 and are at an angle of sixty degrees to each other, as dictated due to passing through their respective in-line series of hexagonal openings.

As can be seen by the configuration of the fold lines 2112, 2114, when the first front portion 2106 and the second front portion 2108 are folded up, the base portion will change from having the circular/rounded front profile to pointed "V" profile. Thus, the urinal screen 2100 can be used in urinals having round basins as well as urinals having pointed basins.

Breaks such as break 2122 can be formed along the edge at regular distances to allow the urinal screen to maintain its shape over time. The material used to make the urinal screen 2100 can include oils for producing fragrance, which will be depleted over time. As the oils leach out of the urinal screen material, the urinal screen will reduce in size. Without the breaks 2122, the urinal screen will warp.

Figure 22:
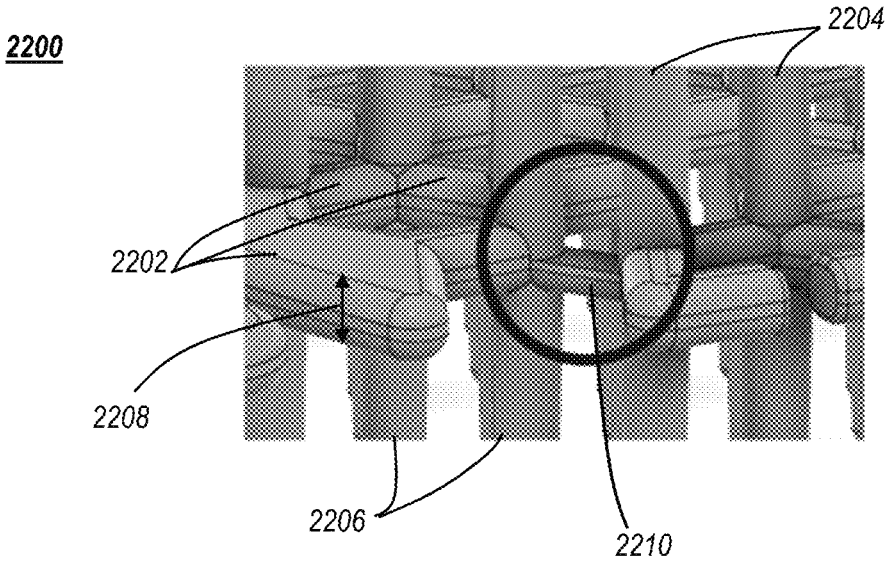
FIG. 22 is a detail side perspective view of the hexagonal webbing showing reduced thickness in the connector sections across a fold line, in accordance with some embodiments.

FIG. 22 is a detail side perspective view 2200 of the hexagonal webbing showing reduced thickness in the connector sections across a fold line, in accordance with some embodiments. The webbing is made of connector portions such as connector portions 2202 that are configured generally in hexagonal shapes; each connector link 2202 is at an angle of one hundred twenty degrees to the other connector links to which they are joined. Where the connector links 2202 meet, there can be protrusions 2204, 2206 that extend above and below the hexagonal webbing. Generally, the connector links of hexagonal webbing have a thickness 2208. However, along the fold lines, there are reduced thickness connector links 2210 that can have half the thickness of 2208. This reduced thickness facilitates folding the front portions (e.g. 2106, 2108). Thus, creating the fold lines can be accomplished by configuring the webbing such that, along a line, connector links are omitted at some locations, and the remaining connector links can have a reduced thickness to that of connector links in the main portions of the urinal screen.

Figure 23:
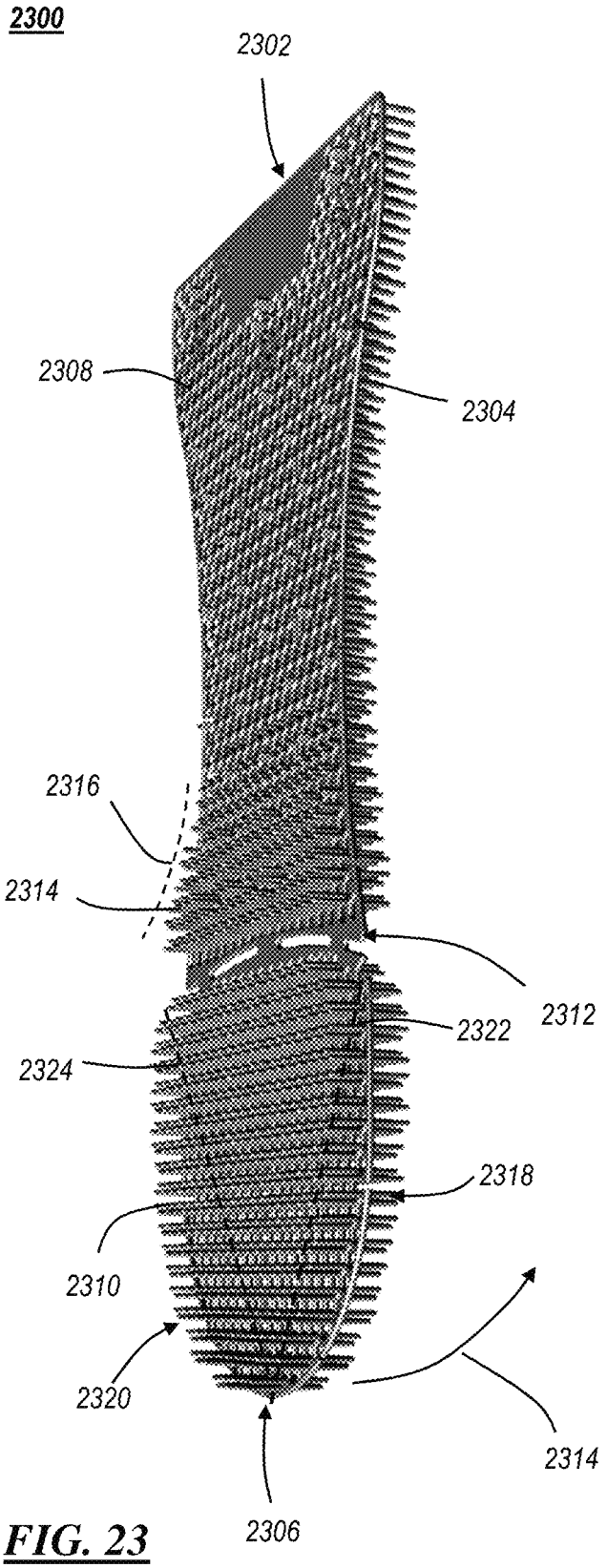
FIG. 23 shows a rear side perspective view of a urinal screen, in accordance with some embodiments.

FIG. 23 shows a rear side perspective view of a urinal screen 2300, in accordance with some embodiments. The urinal screen 2300 includes an anti-splash body 2302 that is configured to be mounted vertically on the back wall of a urinal. The front 2304 comprises a plurality of protrusions that extend perpendicularly or outwardly from a webbing that forms regular hexagonal openings by the arrangement of connector links as previously shown and described. An upper back portion 2308, opposite the front 2304, can lack protrusions, but near the lower end of the anti-splash body 2302, near the coupling region 2312, there can be protrusions 2314 that increase in length closer to the coupling region, as indicated by line 2316.

A base portion 2306 can be substantially identical to the base portion 2104 of FIG. 21, and is configured to be moved in the direction of arrow 2314, bending at the coupling region 2312, so as to rest on the lower surface or basin surface of the urinal. The back or bottom 2310 of the base portion 2306 can include protrusions at each of, or at most of the intersections of the connector links that form the webbing. Furthermore, the first front portion 2318 and second front portion 2320 can be folded along fold lines 2322, 2324, respectively, to fit the base portion 2306 into a pointed urinal basin, or left unfolded for rounded urinal basins.

Figure 24:
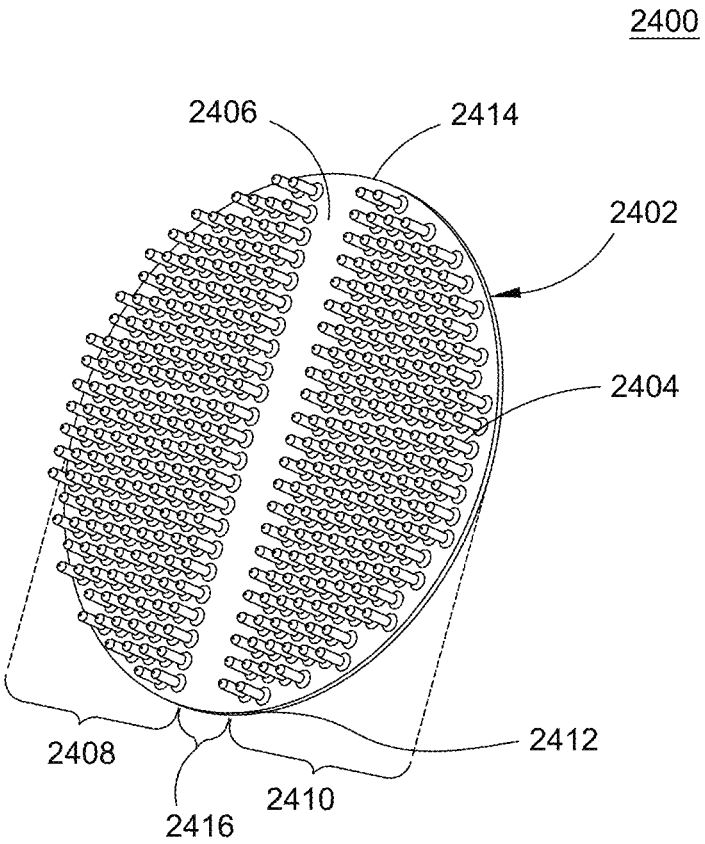
FIG. 24 shows a top plan view of a foldable urinal screen, in accordance with some embodiments.

FIG. 24 shows a top plan view of a foldable urinal screen 2400, in accordance with some embodiments. The urinal screen 2400 has a body 2402 that, when the urinal screen 2400 is laid a flat surface, will be generally planar. The body 2402 has openings through it to allow fluid to pass through the body 2402, and can have a sheet-like configuration or it can be comprised of a webbing such as that shown in FIG. 15. The urinal screen 2400 includes a plurality of protrusions 2404 which extend from the body 2402 outward on a top side of the body. The protrusions 2404 break up fluid streams to prevent splashing and allow the fluid to pass/drain through the body 2402. Across a portion of the body 2402 is a fold line 2406 which is a linear region that lacks protrusions. The fold line 2406 can, in some embodiments, have a width 2416 that is wider than an average or minimum spacing between protrusions 2404, and can be several times greater that the spacing between adjacent protrusions 2404. In some embodiments, the fold line 2406 can be created by thinning the structure of the body 2402 along the fold line, or removing portions of the body 2402 along the fold line, such as in FIGS. 21-22. Thus, the fold line 2406 is a region that is distinguished from the other regions 2408, 2410 on either side of the fold line 2406 due to the lack of protrusions 2404 or a change in the structure of the body 2402 along the fold line 2406, or both, so as to allow the body 2402 to naturally bend along the fold line 2406. The fold line 2406 extends across the body 2402 and can extend, for example, from a front 2412 to a back 2414 of the body 2402. The fold line 2406 allows the body to fold to conform with urinal basins having a "V" profile without resulting in lifted edges that can reduce the anti-splash effectiveness.

In some embodiments where the fold line 2406 is created by reducing the structure of the body 2402 along the fold line, without reducing the protrusions along the fold line 2406, as in FIGS. 21-22, the urinal screen 2400 is suitable for use in either older urinals with a flatter bottom surface, or newer urinals that have more angled bottom surfaces. Embodiments that simply lack protrusions along the fold line, when used in an unbent/folded state, can produce undesirable splash due to fluid incident on the area lacking protrusions. Therefore embodiments using a fold line created by a lack of protrusions are best used only in urinals having angled bottom surfaces with the body of the urinal screen is bent, resulting in protrusions on either side of the fold line covering the region lacking protrusions, thereby eliminating the potential for splash.

Figure 25:
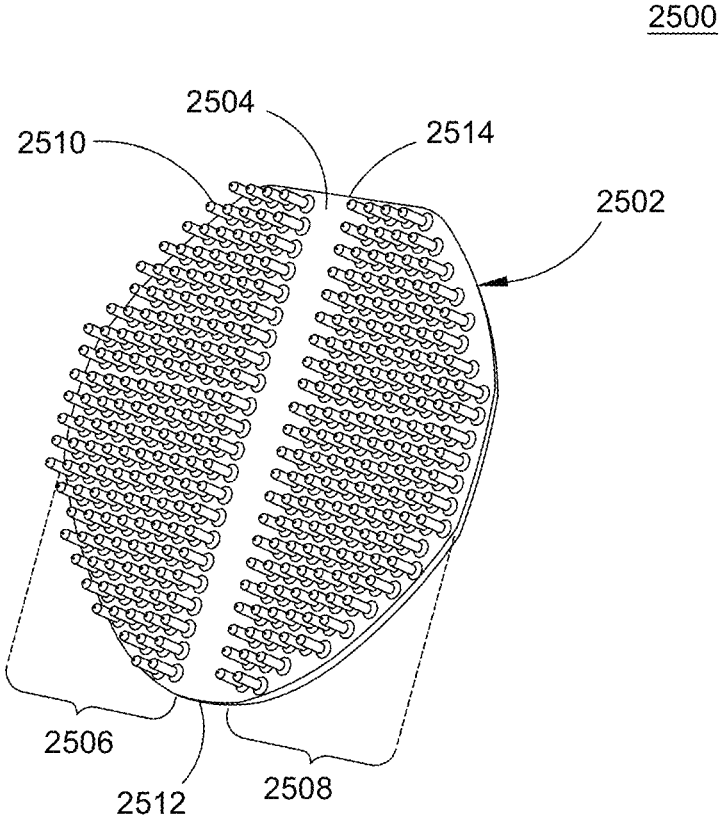
FIG. 25 shows a top plan view of a foldable urinal screen, in accordance with some embodiments.

FIG. 25 shows a top plan view of a foldable urinal screen 2500 having a non-round shape, in accordance with some embodiments. The urinal screen 2500 is substantially similar to that of FIG. 24, but has a different shape that is suitable for different types of urinals. The urinal screen 2500 has a body 2502 from which a plurality of protrusions extend. The protrusions can extend from both the top and bottom, and protrusions extending from the bottom can be shorter that those extending from the top in order to space the body 2502 away from the surface of the basin in order to allow fluid to pass through the body 2502. A fold line 2504 can extend across the body 2502, from a front 2512 to the rear 2514 of the body. The fold line 2504 is a linear region that is designed to facilitate bending of the body 2502 along the fold line 2504. It should be noted that although the term "fold" is used here, it is not meant to indicate that one portion of the urinal screen is folded completely over, and onto another portion, rather, the urinal screen is allowed to bend more easily than if there was no fold line (e.g. 2504, 2406). Thus, portion 2506 on one side of the fold line 2504 can be at an angle to portion 2508 on the other side of the fold line 2504 when the urinal screen is placed in a urinal basin. In the present example of FIG. 25, the front 2512 is pointed, while the back 2514 has a wider, more flat/straight outline giving the body 2502 a rounded triangular shape. As with FIG. 24, the fold line 2504 can be a region that lacks protrusions, or it can be a region in which the structure of the body 2502 is reduced, or both, to facilitate bending along the fold line 2504 when the urinal screen 2500 is placed in a urinal basin that is narrower and with angled surfaces around the drain.

Figure 26:
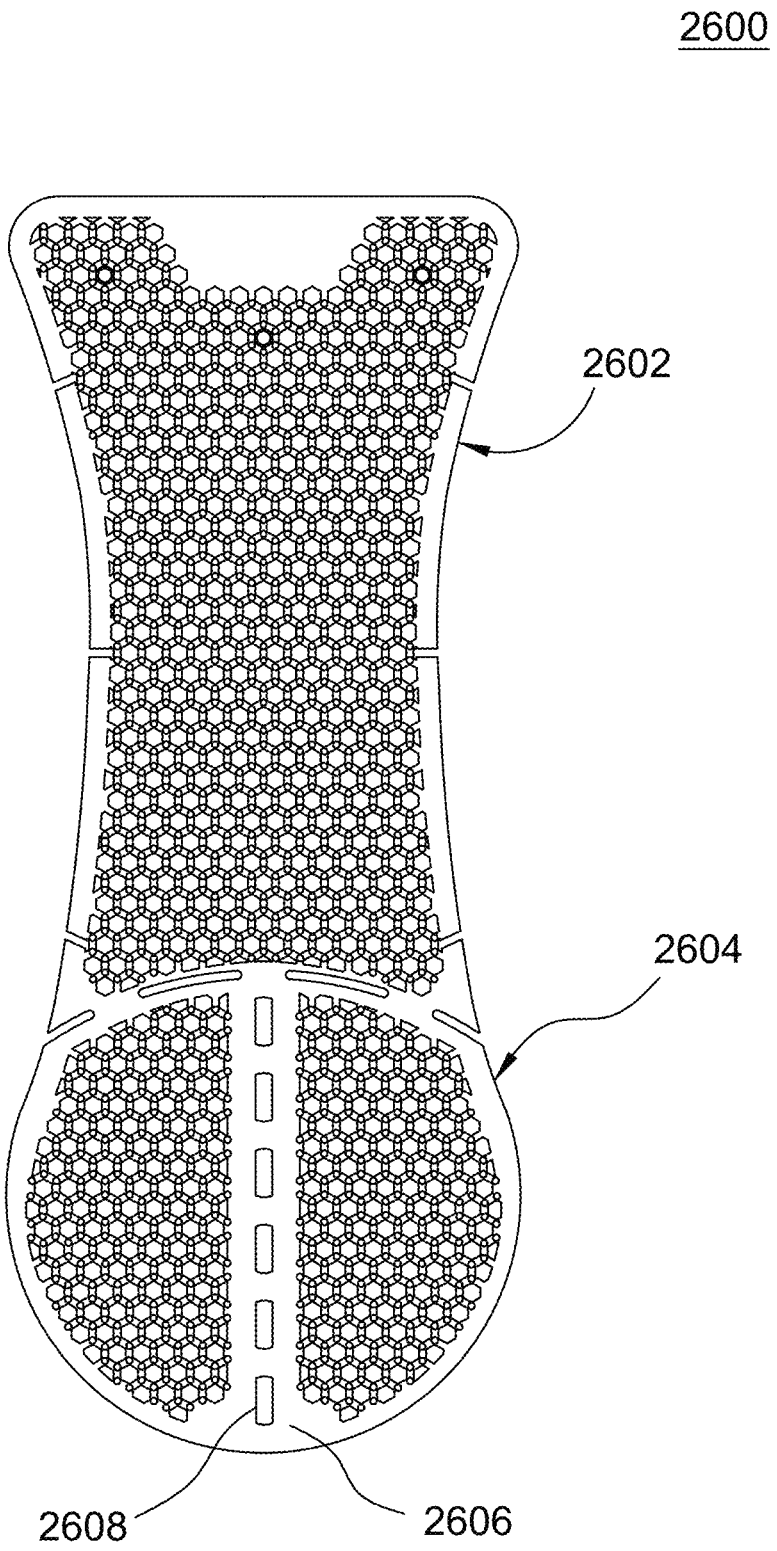
FIG. 26 shows a plan view of a multi-sectioned urinal screen having a foldable base portion that is detachable from an anti-splash body portion.

FIG. 26 shows a plan view of a multi-sectioned urinal screen 2600 having a foldable base portion 2604 that is detachable from an anti-splash body portion 2602. The urinal screen 2600 is substantially similar to that of FIG. 21. However, rather than having two fold lines that extend from the from to the opposite sides of the base portion 2604, the base portion 2604 has one fold line 2606 along which there are no protrusions, which runs from the front to the back of the base portion 2604. To be clear, the back of the base portion 2604 is the region where the base portion 2604 is connected to the anti-splash body portion 2602 and the front is opposite the back across the base portion. Along the fold line 2606 there can be plurality of openings or perforations 2608 to allow fluid to pass through the body of the base portion 2604 along the fold line 2606. The lack of protrusions along the fold line 2606 allows the base portion to bend to conform to the shape of a urinal basin both when attached to the anti-splash body 2602 and when used detached from the anti-splash body.

Figure 27:
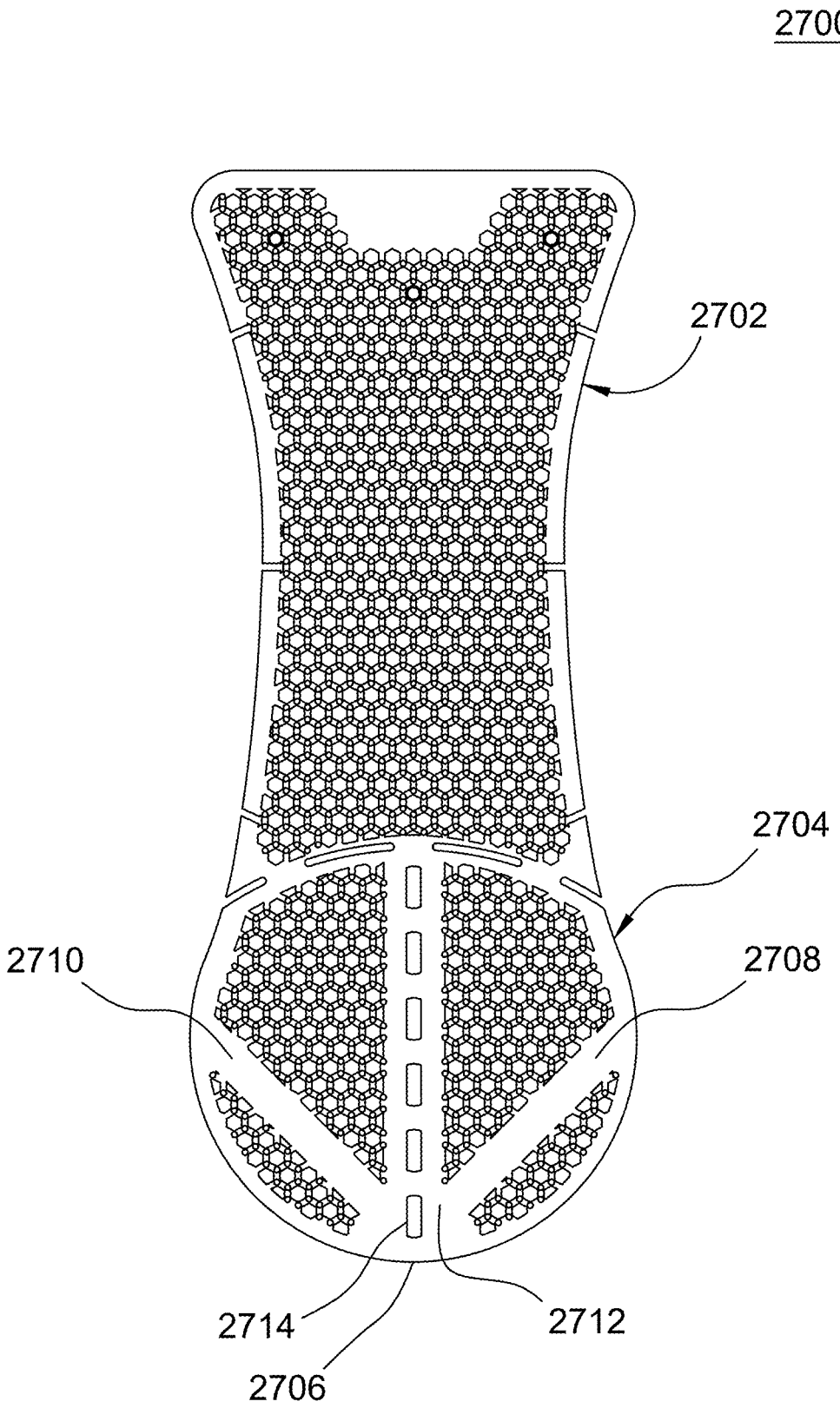
FIG. 27 shows a plan view of a multi-sectioned urinal screen having a foldable base portion that is detachable from an anti-splash body portion.

FIG. 27 shows a plan view of a multi-sectioned urinal screen 2700 having a foldable base portion 2704 that is detachable from an anti-splash body portion 2702. In this example the base portion 2704 includes multiple fold line 2708, 2710, and 2712. The fold lines 2708, 2710, 2712 converge at the front 2706 of the base portion 2704 and run along different portions of the body of the base portion 2704. Fold lines 2708, 2710 extend to opposite sides of the base portion 2704 while fold line 2712 runs from the front 2706 to the back of the base portion 2704. As in FIG. 26, the fold line 2712 can have openings 2714 to allow fluids to pass through the body of the base portion 2704. The rest of the base portion 2704 also has openings (e.g. between protrusions) for drainage. Likewise, fold lines 2708, 2710 can also have openings such as openings 2714.

A urinal anti-splash device has been disclosed that not only includes an anti-splash body and a base that may be separated from each other to cover a back wall and a urinal screen to prevent urine from splashing onto a user of the urinal, but also provides an front surface conducive for allowing the urine and/or water to flow in a downward direction toward the urinal drain. Further, a urinal screen and base portion of a urinal anti-splash device have been disclosed to include at least one fold line to allow the urinal screen/base portion to bend in conformance with the contours of newer urinal basins. It will be appreciated by those skilled in the art that other arrangements of fold lines can be used in addition to those embodiments explicitly disclosed herein. For example, a urinal screen can include two or more parallel fold lines, crossing or intersecting fold lines, fold lines that have a varying width (e.g. tapering), among other variations that are to be considered equivalent.

What is claimed is:

1. A urinal screen adaptable to a plurality of urinal configurations, comprising a main body having a plurality of protrusions extending away from the main body on a top side of the urinal screens; and at least one fold line across the top of the main body.

2. The urinal screen of claim 1, wherein the at least one fold line comprises a plurality of perforations through the urinal screen.

3. The urinal screen of claim 1, wherein the at least one fold line comprises a fold line from a front of the main body to a back of the main body.

4. The urinal screen of claim 1, wherein the main body is comprised of a honeycomb webbing defining hexagonal openings and intersecting portions of the webbing, wherein each one of the plurality of protrusions extends from a respective one of the intersecting portions and wherein the fold line is created by a reduced structure of the main body along the fold line.

5. The urinal screen of claim 1, wherein the urinal screen is joined to an anti-splash body opposite a front of the urinal screen, at a coupling region.

6. The urinal screen of claim 5, wherein the coupling region comprises a plurality of perforations along the coupling region.

7. The urinal screen of claim 1, wherein the at least one fold line comprises first, second, and third fold lines that all converge at a front of the main body.

8. A urinal screen, comprising:

an anti-splash body;

a base portion joined to the anti-splash body at a coupling region;

the anti-splash body and base portion each comprising a plurality of protrusions extending outwardly; and the base portion having at least one fold line across a top of the base portion, wherein the at least one fold line is a region along the base portion in either there is a lack of protrusions or a structure of the base portion is reduced.

9. The urinal screen of claim 7, wherein the anti-splash body and base portion each comprise a webbing comprised of connector links that are arranged to form openings through the anti-splash body and the base portion, and wherein protrusions of the plurality of protrusions extend from intersections of the connector links.

10. The urinal screen of claim 9, wherein the openings are hexagonal openings.

11. The urinal screen of claim 9, wherein at least some connector links are omitted along the at least one fold line.

12. The urinal screen of claim 9, wherein at least some connector links have a reduced thickness along the at least one fold line relative to connector links not along the at least one fold line.

13. The urinal screen of claim 8, wherein the coupling region comprises perforations.

14. The urinal screen of claim 8, wherein the plurality of protrusions extend outwardly and perpendicularly to a plane of the anti-splash body and base portion.

15. The urinal screen of claim 8, further comprising a plurality of breaks at an edge of the anti-splash body and base portion.

16. The urinal screen of claim 15, wherein a material of the anti-splash body and base portion includes a fragrance oil.

* * * * *